US007690066B2

(12) United States Patent
Stoltz et al.

(10) Patent No.: US 7,690,066 B2
(45) Date of Patent: Apr. 6, 2010

(54) AUTOMATIC POOL CLEANER

(75) Inventors: Gerhard J. Stoltz, Temecula, CA (US); Kenneth A. Bloch, San Diego, CA (US); Alan L. Harmon, Placentia, CA (US); John D. Piburn, Long Beach, CA (US); Carlo M. S. Santos, San Marcos, CA (US); Neil R. Bergstrom, LaMesa, CA (US)

(73) Assignee: Zodiac Pool Care, Inc., Vista, CA (US)

( * ) Notice: Subject to any disclaimer, the term of this patent is extended or adjusted under 35 U.S.C. 154(b) by 1169 days.

(21) Appl. No.: 11/265,873

(22) Filed: Nov. 3, 2005

(65) Prior Publication Data

US 2007/0094817 A1 May 3, 2007

(51) Int. Cl.
*E04H 4/16* (2006.01)

(52) U.S. Cl. ..... 15/1.7

(58) Field of Classification Search ..... 15/1.7
See application file for complete search history.

(56) References Cited

U.S. PATENT DOCUMENTS

| | | | | |
|---|---|---|---|---|
| 3,803,658 | A | 4/1974 | Raubenheimer | |
| 3,822,754 | A | 7/1974 | Henkin et al. | |
| 3,895,402 | A * | 7/1975 | Page | 4/508 |
| 4,023,227 | A | 5/1977 | Chauvier | |
| 4,117,602 | A | 10/1978 | Lapeyre | |
| 4,133,068 | A | 1/1979 | Hofmann | |
| 4,190,962 | A | 3/1980 | Lyman, Jr. | |
| 4,208,752 | A | 6/1980 | Hofmann | |
| 4,436,125 | A | 3/1984 | Blenkush | |
| 4,518,437 | A | 5/1985 | Sommer | |
| 4,541,457 | A | 9/1985 | Blenkush | |
| 4,558,479 | A | 12/1985 | Greskovics et al. | |
| 4,575,423 | A | 3/1986 | Alanis et al. | |
| 4,589,986 | A | 5/1986 | Greskovics et al. | |
| 4,618,420 | A | 10/1986 | Alanis | |
| D288,373 | S | 2/1987 | Alanis | |
| 4,643,217 | A | 2/1987 | Frentzel | |
| 4,679,867 | A | 7/1987 | Heldenbrand et al. | |
| D294,963 | S | 3/1988 | Alanis et al. | |
| 4,729,406 | A | 3/1988 | Frentzel | |
| 4,734,954 | A | 4/1988 | Greskovics et al. | |

(Continued)

FOREIGN PATENT DOCUMENTS

| | | |
|---|---|---|
| WO | WO 2004/019295 | 3/2004 |

(Continued)

*Primary Examiner*—David B Thomas
(74) *Attorney, Agent, or Firm*—Dean W. Russell; Kilpatrick Stockton LLP

(57) ABSTRACT

An automatic pool cleaner is provided of the type for random travel over submerged floor and side wall surfaces of a swimming pool or the like to dislodge and collect debris. The pool cleaner includes an electric-powered traction drive system for rotatably driving cleaner wheels, and an electric-powered water management system including a water supply pump and related manifold unit for venturi-vacuuming and collection of settled debris within a porous filter bag. A directional control system including an on-board compass monitors turning movements of the pool cleaner during normal random travel operation, and functions to regulate the traction drive system in a manner to prevent, e.g., excess twisting of a conduit such as a power cable tethered to the pool cleaner.

17 Claims, 26 Drawing Sheets

U.S. PATENT DOCUMENTS

| | | | | | |
|---|---|---|---|---|---|
| 4,761,848 | A | | 8/1988 | Hofmann | |
| 4,786,334 | A | | 11/1988 | Nystrom | |
| 4,846,714 | A | * | 7/1989 | Welsby et al. | 439/348 |
| 5,105,496 | A | | 4/1992 | Gray, Jr. et al. | |
| 5,162,870 | A | | 11/1992 | Toth | |
| 5,256,207 | A | * | 10/1993 | Sommer | 134/18 |
| 5,265,297 | A | | 11/1993 | Gould et al. | |
| 5,316,041 | A | | 5/1994 | Ramacier, Jr. et al. | |
| 5,435,031 | A | * | 7/1995 | Minami et al. | 15/1.7 |
| 5,477,470 | A | | 12/1995 | Lewis | |
| 5,507,058 | A | * | 4/1996 | Minami et al. | 15/1.7 |
| 5,517,430 | A | | 5/1996 | Lewis | |
| 5,569,371 | A | | 10/1996 | Perling | |
| 5,634,229 | A | | 6/1997 | Stoltz | |
| 5,863,425 | A | | 1/1999 | Herlehy et al. | |
| D409,341 | S | | 5/1999 | Van Etten et al. | |
| 5,985,156 | A | * | 11/1999 | Henkin et al. | 210/744 |
| 6,094,764 | A | | 8/2000 | Veloskey et al. | |
| 6,112,354 | A | | 9/2000 | Stoltz et al. | |
| 6,206,547 | B1 | * | 3/2001 | Erlich | 362/276 |
| 6,299,699 | B1 | | 10/2001 | Porat et al. | |
| 6,412,133 | B1 | | 7/2002 | Erlich et al. | |
| D468,067 | S | | 12/2002 | Stoltz et al. | |
| 6,652,742 | B2 | | 11/2003 | Henkin et al. | |
| 6,665,900 | B2 | | 12/2003 | Wichmann et al. | |
| 6,740,233 | B2 | | 5/2004 | Stoltz et al. | |
| 6,758,226 | B2 | | 7/2004 | Porat | |
| 6,815,918 | B2 | | 11/2004 | Porat et al. | |
| 6,842,931 | B2 | | 1/2005 | Porat et al. | |
| 6,908,550 | B2 | | 6/2005 | Silverstein | |
| 6,965,814 | B2 | * | 11/2005 | Hadari | 700/282 |
| 7,117,554 | B2 | * | 10/2006 | Pichon | 15/1.7 |
| 7,165,284 | B2 | * | 1/2007 | Erlich et al. | 15/1.7 |
| 2001/0048364 | A1 | | 12/2001 | Kalthoff et al. | |
| 2003/0159723 | A1 | | 8/2003 | Hui | |
| 2003/0168516 | A1 | * | 9/2003 | Cline | 237/2 A |
| 2004/0025268 | A1 | | 2/2004 | Porat et al. | |
| 2004/0168299 | A1 | | 9/2004 | Porat et al. | |
| 2004/0168838 | A1 | | 9/2004 | Erlich et al. | |
| 2005/0029177 | A1 | | 2/2005 | Peterson, Jr. et al. | |
| 2005/0040089 | A1 | | 2/2005 | Meritt-Powell | |
| 2005/0236310 | A1 | | 10/2005 | Meritt-Powell | |
| 2006/0143841 | A1 | * | 7/2006 | Niewiarowski | 15/1.7 |
| 2007/0067930 | A1 | * | 3/2007 | Garti | 15/1.7 |

FOREIGN PATENT DOCUMENTS

| | | |
|---|---|---|
| WO | WO 2005/035909 | 4/2005 |
| WO | WO 2005/0045162 | 5/2005 |

* cited by examiner

AUTOMATIC POOL CLEANER

BACKGROUND OF THE INVENTION

This invention relates generally to pool cleaner devices for dislodging and/or collecting debris within swimming pools and the like. More particularly, this invention relates to an improved pool cleaner of the type designed for generally random travel along submerged floor and side wall surfaces of a swimming pool to dislodge and collect fine sediment and other particulate debris accumulated thereon. The improved pool cleaner is adapted for electric powered operation, and/or includes a directional control system for monitoring cleaner movements in a manner to prevent, e.g., excess twisting of a conduit such as a power cable to which the pool cleaner is tethered.

Automatic swimming pool cleaners are well known in the art for use in maintaining a swimming pool in an overall state of cleanliness. In this regard, residential and commercial swimming pools normally include a standard water filtration system including a main circulation pump and related main filter unit for filtering the pool water. The filtration system is typically operated for several hours on a daily basis to draw water from the pool for flow through the main filter unit and subsequent return circulation to the pool, wherein the filter unit includes an appropriate filter media for collecting and thus removing solid debris such as fine grit and silt, twigs, leaves, insects, and other particulate matter suspended within the pool water. Although such filtration systems function efficiently to collect suspended particulate, it has been recognized that some particulate tends to settle onto submerged pool floor and wall surfaces and thus is not removed by the standard filtration system. Automatic swimming pool cleaners have been developed and are widely used to assist in a more thorough cleaning of the pool by directly collecting such settled matter, and/or by re-suspending the settled matter so that it can be collected by the main filter unit.

More specifically, in one common form, the automatic swimming pool cleaner comprises a relatively compact wheeled housing adapted to travel randomly over submerged floor and wall surfaces of the pool. The cleaner is normally connected by a water supply hose or the like to the standard filtration system, such as by connection to the positive pressure discharge side of the system as described in U.S. Pat. Nos. 6,665,900; 5,863,425; 4,558,479; 4,589,986; and 3,822,754. The filtration system provides a water flow through the supply hose to the cleaner, wherein this water flow is typically used to create or induce an upwardly directed suction flow through a suction mast for vacuuming grit and debris through the suction mast into a porous filter bag mounted on an upper or downstream end thereof. Exemplary filter bags of this general type and related techniques for removable mounting onto the pool cleaner suction mast are shown and described in U.S. Pat. Nos. 4,618,420; D288,373; 4,575,423; D294,963; 4,589,986; 5,863,425; 6,740,233; 6,908,550; D409,341; and D468,067; and in copending U.S. Ser. Nos. 10/911,188; 10/917,790; and 11/103,714. The water flow through the pool cleaner may also be used to power a hydraulic drive means which causes the cleaner to travel about within the swimming pool.

In alternative hydraulically powered pool cleaner designs, the pool cleaner is adapted for connection to the suction side of the filtration system, whereby water is drawn through the pool cleaner to operate a drive mechanism for transporting the cleaner within the pool while vacuuming settled debris to the filter canister of the pool filtration system. See, for example, U.S. Pat. Nos. 3,803,658; 4,023,227; 4,133,068; 4,208,752; 4,643,217; 4,679,867; 4,729,406; 4,761,848; 5,105,496; 5,265,297; 5,634,229; 6,094,764; and 6,112,354.

Some pool cleaners have been developed for electric-powered operation to travel over submerged surfaces of a swimming pool or the like to dislodge and/or collect settled debris. See, for example, U.S. Pat. Nos. 4,518,437; 4,786,334; 5,569,371; 6,299,699; 6,412,133; 6,652,742; 6,758,226; 6,815,918; 6,842,931; and 6,908,550; and U.S. Publications 2003/0159723; 2004/0168838; and 2004/0168299; and PCT Publication WO 2005/0045162. In some such designs, these electric-powered pool cleaners are tethered to a power cord which is coupled in turn to a suitable electric power source or power module at a deckside or other dry site location near the swimming pool. Other electric-powered pool cleaners envision an on-board rechargeable battery power source.

The present invention relates to improvements in automatic pool cleaner devices of the electric powered type, including, e.g., an improved traction drive system and related pressurized water management system for vacuuming and collecting settled debris by venturi action, and further including an improved directional control system for preventing, e.g., excess twisting of a tether conduit such as a power cable.

SUMMARY OF THE INVENTION

In accordance with the invention, an automatic pool cleaner is provided of the type for random travel over submerged floor and side wall surfaces of a swimming pool or the like to dislodge and collect debris. The pool cleaner includes an electric-powered traction drive system for rotatably driving cleaner wheels, and an electric-powered water management system including a water supply pump and related manifold unit for venturi-vacuuming and collection of settled debris within a porous filter bag. A directional control system including an on-board compass monitors turning movements of the pool cleaner during normal random travel operation, and functions to regulate the traction drive system in a manner to prevent, e.g., excess twisting of a conduit such as a power cable tethered to the pool cleaner.

In the preferred form, the pool cleaner comprises a compact cleaner housing supported by a plurality of wheels for traction drive rolling movement over submerged floor and side wall surfaces of a swimming pool or the like. The cleaner wheels are positioned at opposed lateral or opposed left and right sides of the cleaner housing and are respectively driven by a corresponding pair of left and right sealed drive motors such as a pair of stepper motors for appropriate forward, reverse, or turning movement. These drive motors are mounted within the cleaner housing on an internal support frame. A control processor is programmed for operating these drive motors to regulate the direction of cleaner travel throughout the swimming pool or the like. A power cable is tethered to the pool cleaner, in one preferred form, to provide a suitable source of electric power.

The directional control system includes an on-board, gimbal-mounted compass for providing a directional input signal to the control processor. In accordance with one aspect of the invention, the control processor responds to this directional input signal to regulate the direction of cleaner travel within the swimming pool, particularly with respect to causing the pool cleaner to undergo one or more appropriate turning movements for maintaining the power cable is a relatively untwisted state.

The electric-powered water supply pump is also mounted on the internal support frame within the cleaner housing. This water supply pump includes a rotary-driven impeller for drawing in a supply of water and for delivering that water under pressure to a manifold unit. The manifold unit includes a plenum or pressure chamber communicating with an annular jet nozzle ring, or alternately with at least one and preferably multiple jet nozzles, disposed generally at a lower end of a pool cleaner suction mast and aimed upwardly to induce by venturi action an upwardly directed suction flow of water therethrough into a filter bag mounted at an upper end of the suction mast. An open lower end of the suction mast is defined by the cleaner housing in close proximity with an underlying pool surface, whereby this upwardly directed suction flow effectively vacuums settled debris from the underlying pool surface into the filter bag.

In a preferred form, the manifold unit may also include one or more upwardly directed thrust jets through which a stream of water is projected upwardly from the cleaner housing, resulting in a downward reaction force to improve wheel traction with the associated underlying pool surface.

The water supply pump comprises a sealed pump motor housing encasing the drive motor, with a rotary output shaft coupled with and rotatably driving the impeller. In one preferred form, the output shaft protrudes from the motor housing in association with a double lip seal which prevents water intrusion into the motor housing. In an alternative preferred form, the output shaft is coupled to the impeller by means of an hermetically sealed magnetic drive coupling.

The on-board compass of the directional control system is mounted at an externally visible and preferably elevated position, such as by mounting the compass at an upper and rearwardly disposed location on the cleaner housing. In this position, with a portion of a compass housing formed from a transparent or partially transparent material, movements of the gimbal-mounted compass can be visually observed. In addition, the compass housing may define a sealed and predominantly hollow compass chamber that additionally functions as a ballast float for the pool cleaner. In one form, externally visible indicator lights may be mounted within the compass housing, wherein such indicator lights may be illuminated to indicate a variety of operational conditions, and may be externally observed.

In accordance with a further aspect of the invention, the cleaner housing incorporates a removable access panel or vacuum plate at the underside thereof, generally in surrounding relation to the open lower end of the suction mast. This lower vacuum plate is quickly and easily removable as a modular component to exposed internal operating components for service and repair. A perforated strainer or filter screen is mounted within the cleaner housing in close proximity with the vacuum plate, and cooperates therewith to define a filtered internal chamber from which water is drawn by the water supply pump for hydraulically powering components of the water management system.

The control processor may incorporate a variety of directional control programs for regulating the direction of cleaner travel within the swimming pool. For example, the processor may be programmed for accommodating substantially random cleaner travel, subject to periodic directional adjustments to prevent excess twisting of the power cable. Alternately, the processor may be programmed for regulating cleaner travel through a precise sequence of directional steps and distances which may be subject to periodic adjustments to prevent excess power cable twisting. As a further alternative, the control processor can be designed and programmed, in conjunction with the directional control system, for monitoring pool cleaner movements in the course of initial operation for self-program development of a memory map reflecting actual pool geometry, and thereafter control pool cleaner movements according to a programmed pattern developed from or selected in accordance with the memory map. The control processor can be set for automatic on-off operation for a selected timed cycle, or manually turned on and off.

The control processor may also include safety shut-off means including a sensor for determining a fault condition wherein cleaner operation is not desirable, and for thereupon implementing corrective action or otherwise turning the cleaner off until the problem is corrected. In one preferred form, the sensor comprises a pair of conductive probes mounted in closely spaced relation for verifying that the cleaner is properly submerged in water. In the absence of water including conductive particles between the probes, the processor may be programmed to shut off the pool cleaner, or otherwise undergo one or more back-up cycles and/or turning movements in before shutting off the pool cleaner in the event that such movements do not remedy the problem. Alternately, the sensor may take other fault-detection forms, such as detecting and responding to other fault conditions such as motor or pump overheating and/or motor or pump overload.

In a further alternative form, the control processor may incorporate a receiver for use in remote wireless communication with a suitable remote communication device, such as a transmission/receiver device or the like positioned outside the pool and adapted for preferably bi-directional communication with the control processor via the receiver as by means of suitable wireless information transmission technology. The communication device may be employed, for example, for use in programming the control processor, as by providing, e.g., a database of selected patterns of pool cleaner movement from which a preferred program may be supplied to the control processor. In this regard, the remote communication device may be provided as part of or otherwise may be compatible with a pool equipment control system such as the pool control system available from Polaris Pool Systems, Inc., Vista, Calif. under the product name Eos.

Other features and advantages of the invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
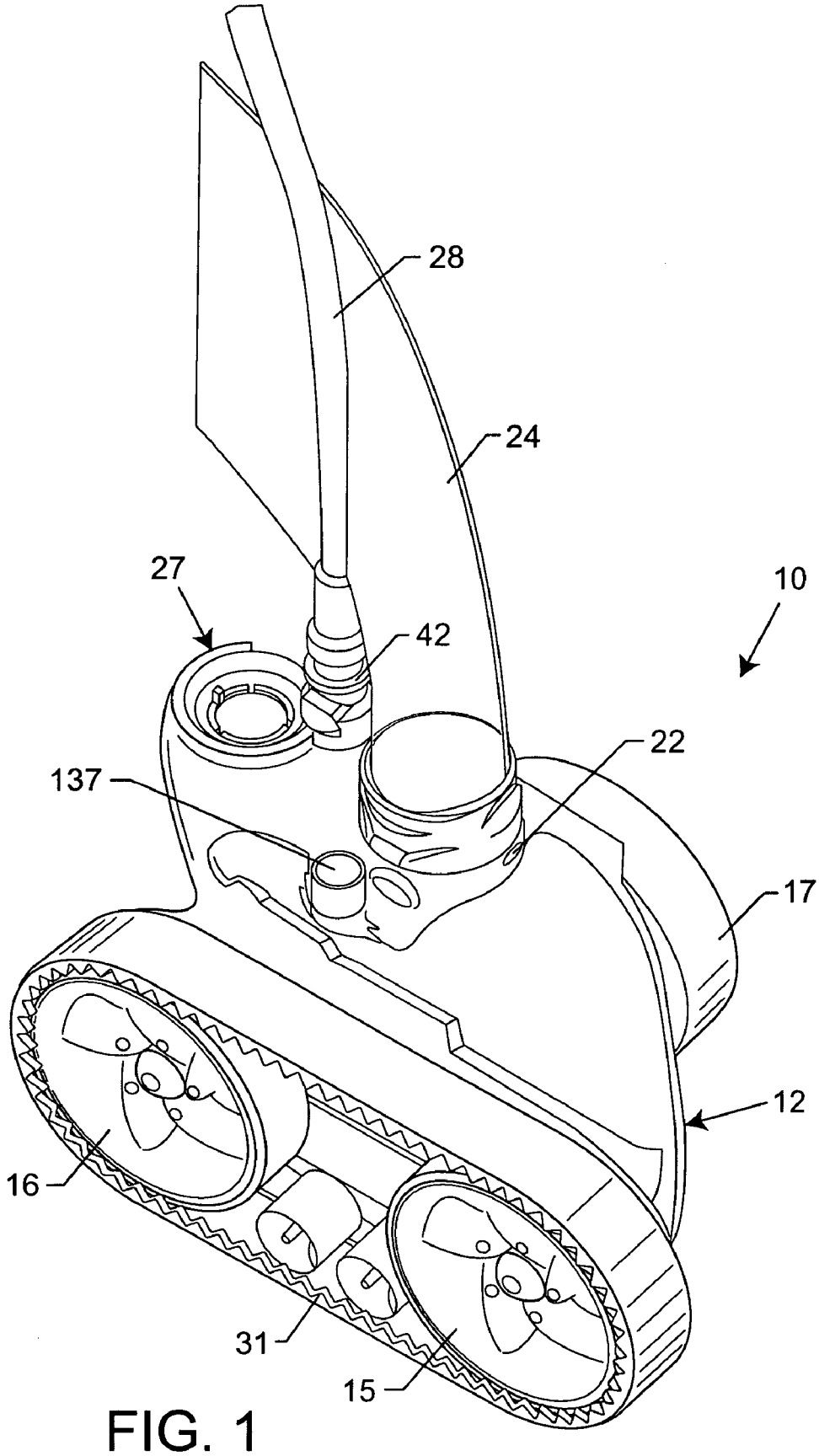
FIG. 1 is a right side perspective view of an automatic pool cleaner embodying, in accordance with one preferred form, the novel features of the invention.

As shown in the exemplary drawings, an improved automatic pool cleaner referred to generally by the reference numeral 10 is provided for travel over submerged floor and side wall surfaces within a swimming pool or the like to dislodge and/or collect debris and sediment. As viewed generally in FIGS. 1-3, the improved pool cleaner 10 comprises an hydraulically contoured or streamlined external housing 12 supported by a plurality of rotatably driven wheels 15, 16 and 17 for travel within the swimming pool or the like. The cleaner housing 12 encases an electric-powered traction drive system 18 (FIGS. 7 and 10-13) for rotatably driving the wheels, and an electric-powered water supply pump 20 (FIGS. 7 and 17-22) for coupling a supply of water under pressure to a suction mast 22 for venturi-action vacuuming of dirt and debris upwardly into a filter bag 24 (FIG. 1). In addition, the improved pool cleaner 10 includes a directional control system 26 (FIGS. 4 and 14-16) including an on-board compass 27 for monitoring and controlling cleaner movement within the pool, particularly with respect to preventing excess twisting of a power cable 28 to which the cleaner 10 is tethered.

Figure 6:
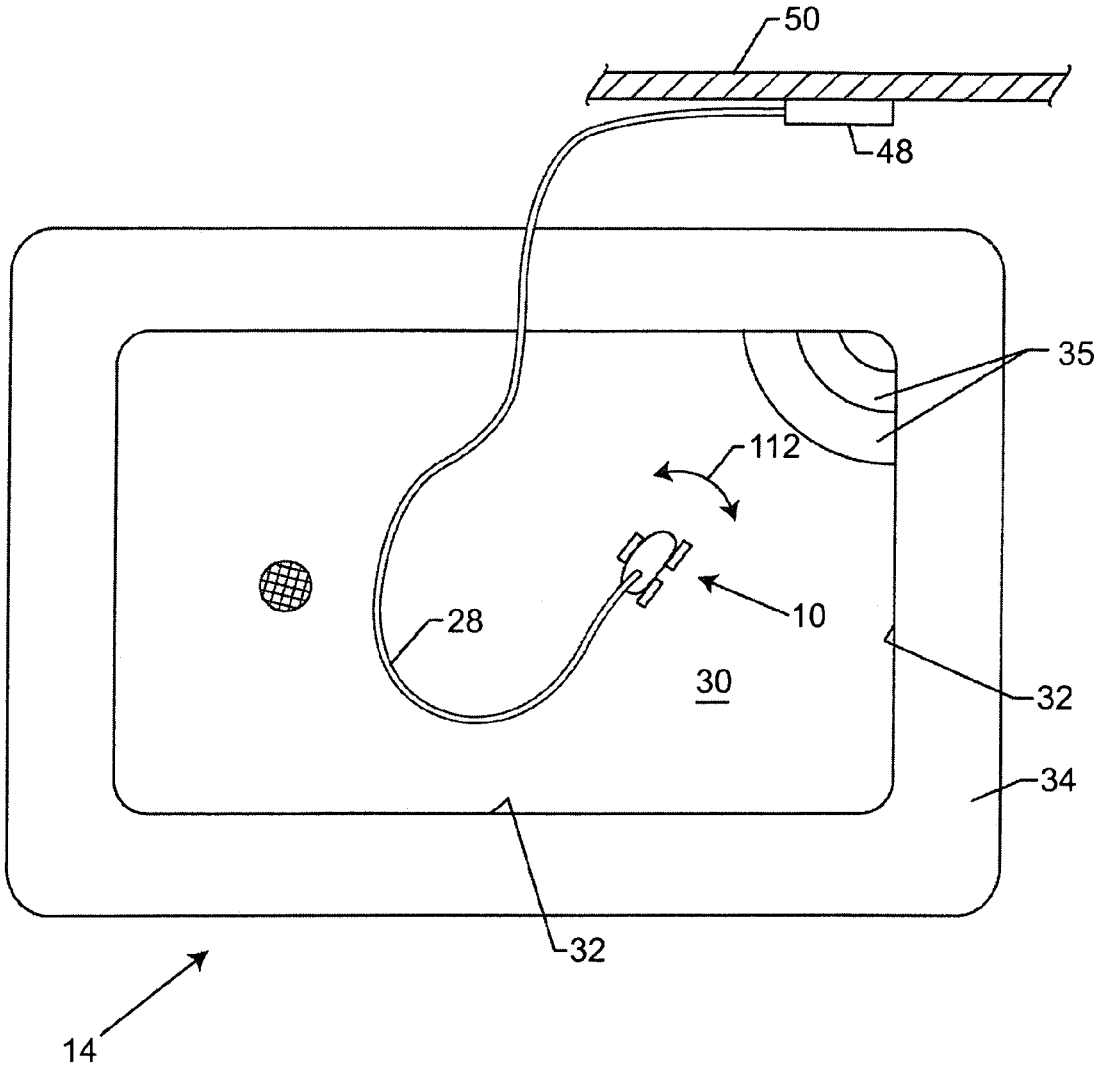
FIG. 6 is a schematic diagram depicting controlled pool cleaner travel over submerged surfaces of an exemplary swimming pool.

The automatic swimming pool cleaner 10 of the present invention constitutes an improvement upon swimming pool cleaners of the general type described in U.S. Pat. Nos. 3,822,754; 4,558,479; 4,589,986; 4,734,954; 5,863,425; and 6,665,900, which are incorporated by reference herein. Such pool cleaners are designed for generally random travel over the floor 30 (FIG. 6) and submerged side walls 32 of a swimming pool 14 having virtually any conventional construction and configuration. In this regard, such swimming pools 14 commonly include the pool floor 30 which may be generally horizontal or of sloping contour to define comparatively shallower and deeper regions of the pool. The illustrative pool floor 30 is joined to and may blend generally smoothly with the side walls 32 which extend upwardly to appropriate decking 34 or the like. The pool 14 may further include steps 35 or the like for facilitated ingress and egress. While FIG. 6 illustrates the pool 14 to have a generally rectangular shape, persons skilled in the art will appreciate that the swimming pool may be constructed in any one of a virtually infinite number of configurations, including smoothly contoured or sharply cornered pool geometries, as well as virtually any type of pool surface such as plaster, tile, fiberglass, vinyl, and others.

In general terms, the improved pool cleaner 10 of the present invention is electrically powered for normal operation to travel back and forth in a generally random pattern, or alternately in a predetermined or self-determined programmed pattern, over the pool floor 30 and to climb the side walls 32 for collecting debris and sediment and the like within the filter bag 24, wherein this particulate matter may have settled onto these submerged pool floor and side wall surfaces. In addition, by traversing these submerged pool surfaces, the pool cleaner 10 dislodges and disturbs other debris and sediment, to maintain such particulate in suspension within the pool water where it can be drawn into and collected by the standard pool water filtration system (not shown). The pool cleaner 10 functions further to circulate and distribute pool chemicals such as chlorine substantially uniformly throughout the pool water, wherein such chemicals are heavier than water and otherwise tend to settle with higher concentrations at or near the bottom of the pool The pool cleaner also serves to circulate water within the pool for achieving a more uniform temperature distribution throughout the body of pool water. Advantageously, the pool cleaner operates automatically and substantially unattended, requiring only occasional emptying of the debris collection or filter bag 24.

Figure 2:
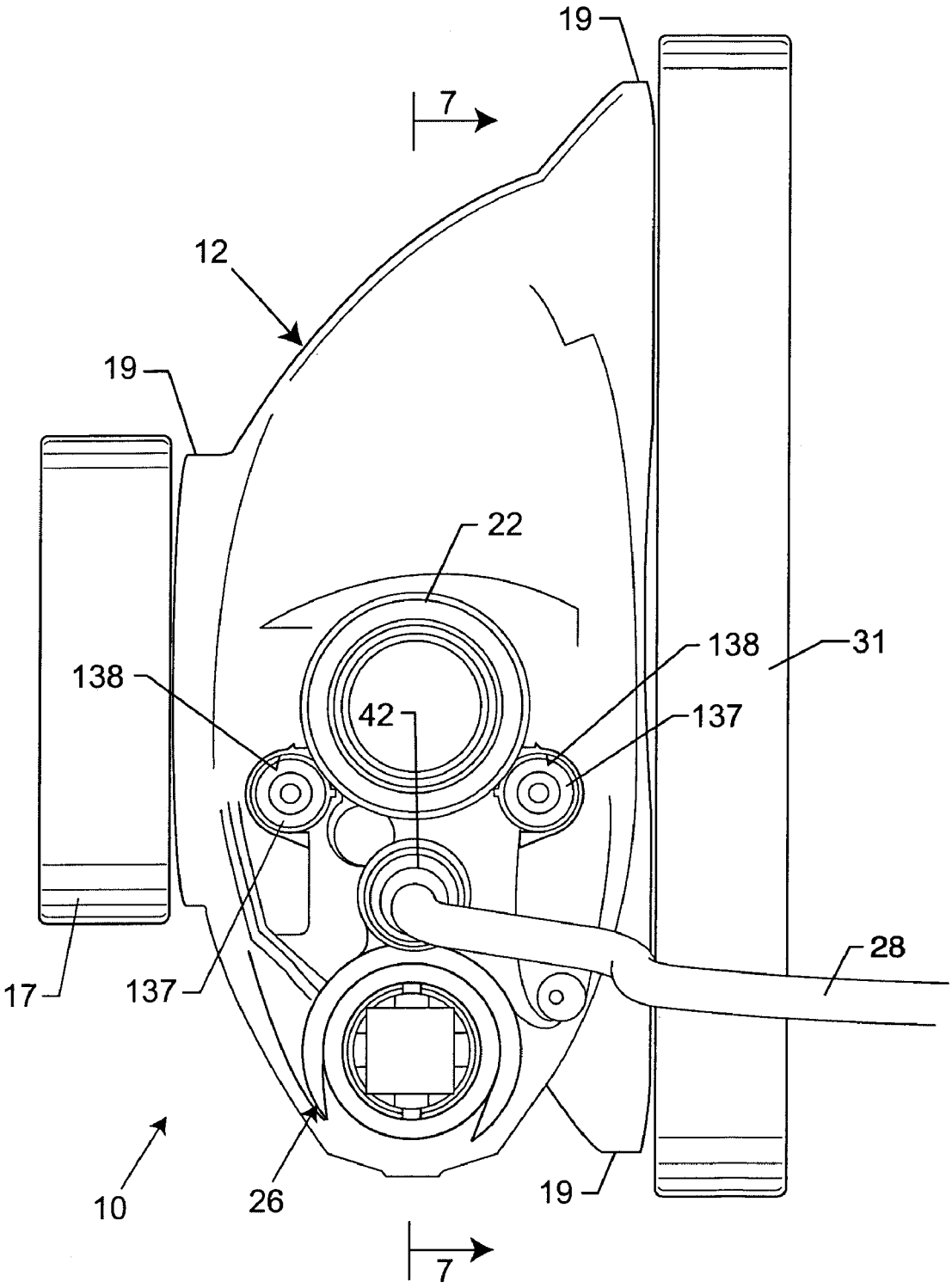
FIG. 2 is a top plan view of the pool cleaner shown in FIG. 1, with an upper debris collection filter bag removed therefrom.
Figure 3:
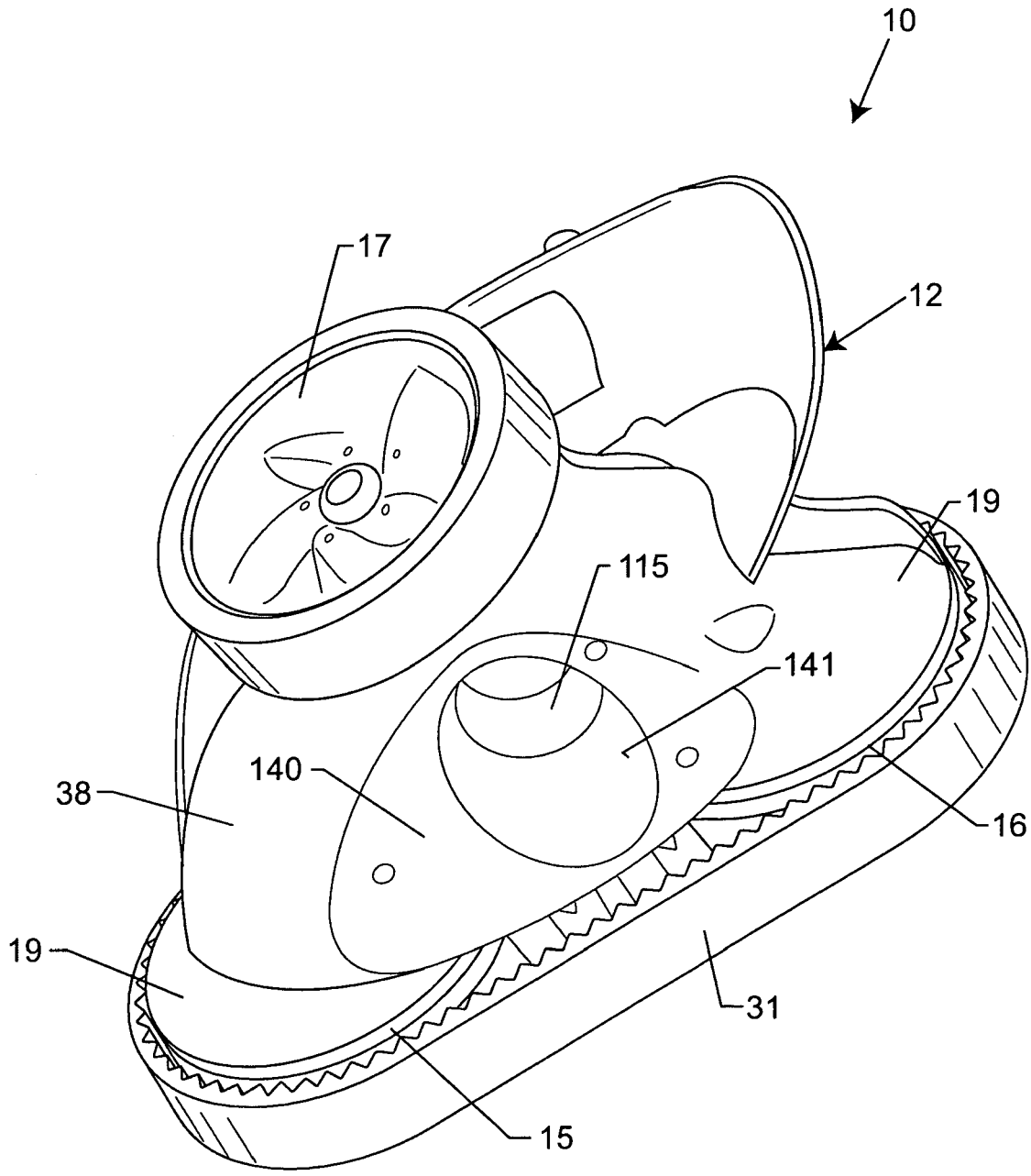
FIG. 3 is a bottom perspective view of the pool cleaner of FIG. 1.

FIGS. 1-3 show the assembled pool cleaner 10 to include the hydraulically contoured external housing 12. Two of the cleaner wheels 15 and 16 respectively comprise front and rear wheels mounted in a spaced front-to-rear orientation at one side of the housing 12. The third cleaner wheel 17 is shown mounted at the opposite side of the housing in a position with its rotational axis offset rearwardly with respect to the front wheel 15, and forwardly with respect to the rear wheel 16. The pool cleaner 10 thus has a generally triangular footprint defined by the three cleaner wheels 15, 16 and 17. In the illustrative drawings, a traction tread 31 is wrapped or reeved about the two right-side wheels 15, 16 for driving those two wheels in unison. Persons skilled in the art will recognize that the traction tread 31 may be omitted and that either or both of the right-side wheels 15, 16 may be separately driven.

With this arrangement, the housing 12 may include a frontal nose configuration extending generally angularly or obliquely in a transverse and rearward direction from the front right-side wheel 15 toward the opposite or left-side wheel 17. The housing 14 may also include a rearward configuration extending generally angularly in a transverse and forward direction from the rear right-side wheel 16 toward the opposite or left-side wheel 17, as shown best in FIG. 2. The housing 14 may conveniently include contoured cowlings 19 at the inboard sides of the cleaner wheels to overlie and substantially conceal drive train components to be described in further detail herein.

Figure 7:
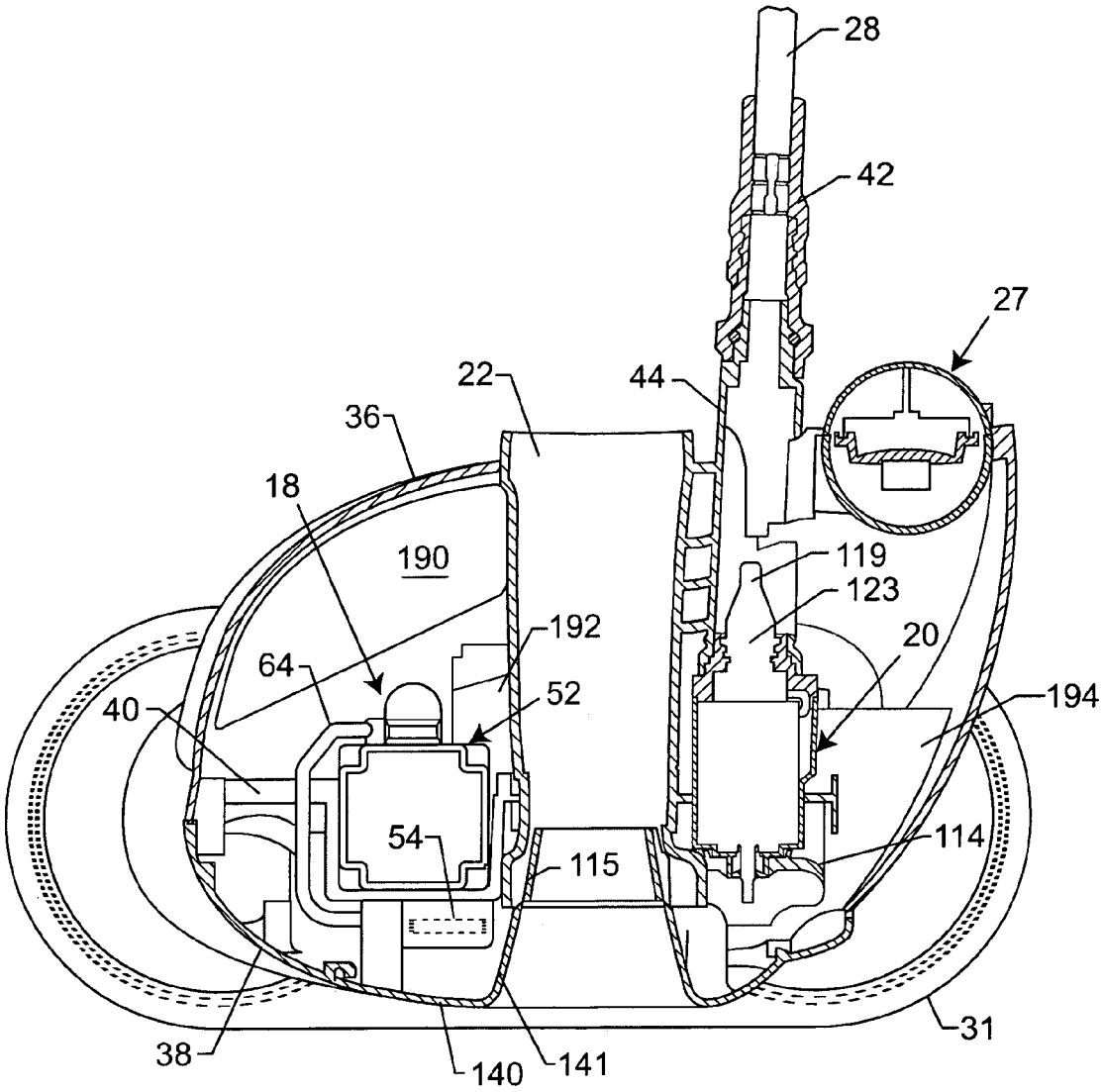
FIG. 7 is an enlarged longitudinal vertical sectional view taken generally on the line 7-7 of FIG. 2.
Figure 10:
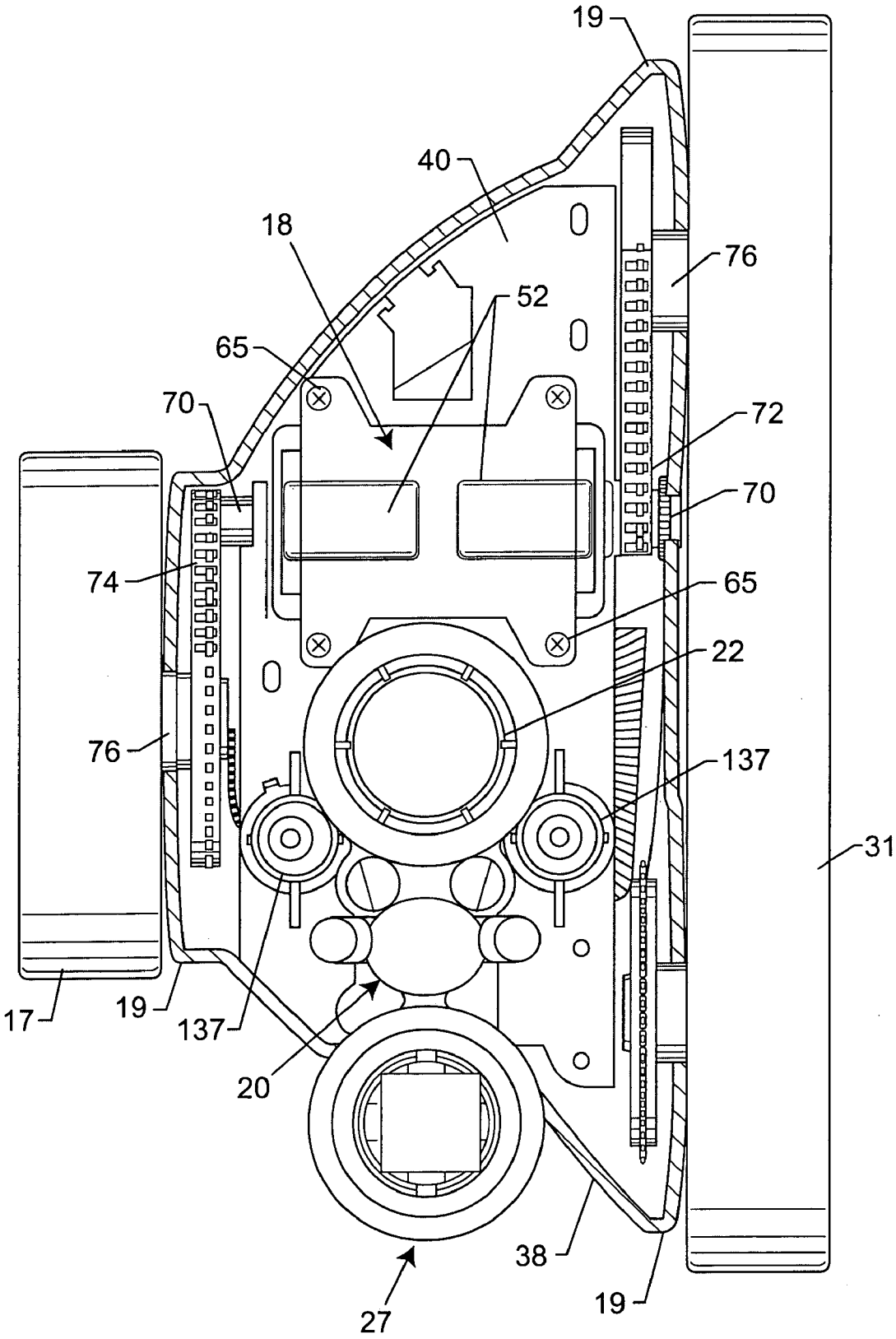
FIG. 10 is top plan view of the pool cleaner similar to FIG. 2, but with an upper housing shell removed to reveal a traction drive system and a water management system mounted therein.
Figure 11:
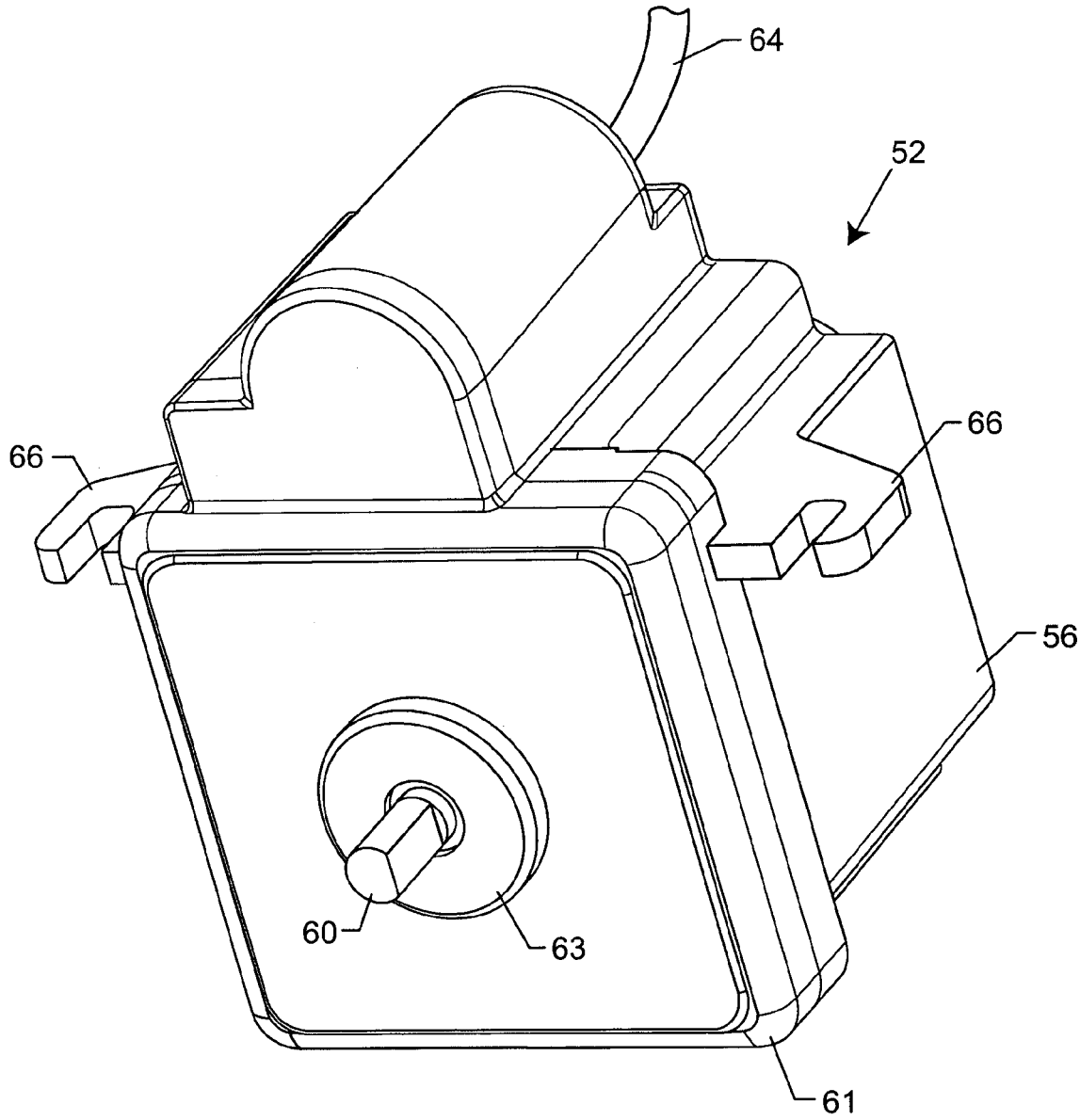
FIG. 11 is an outboard side perspective view of a drive motor for use in the traction drive system.
Figure 12:
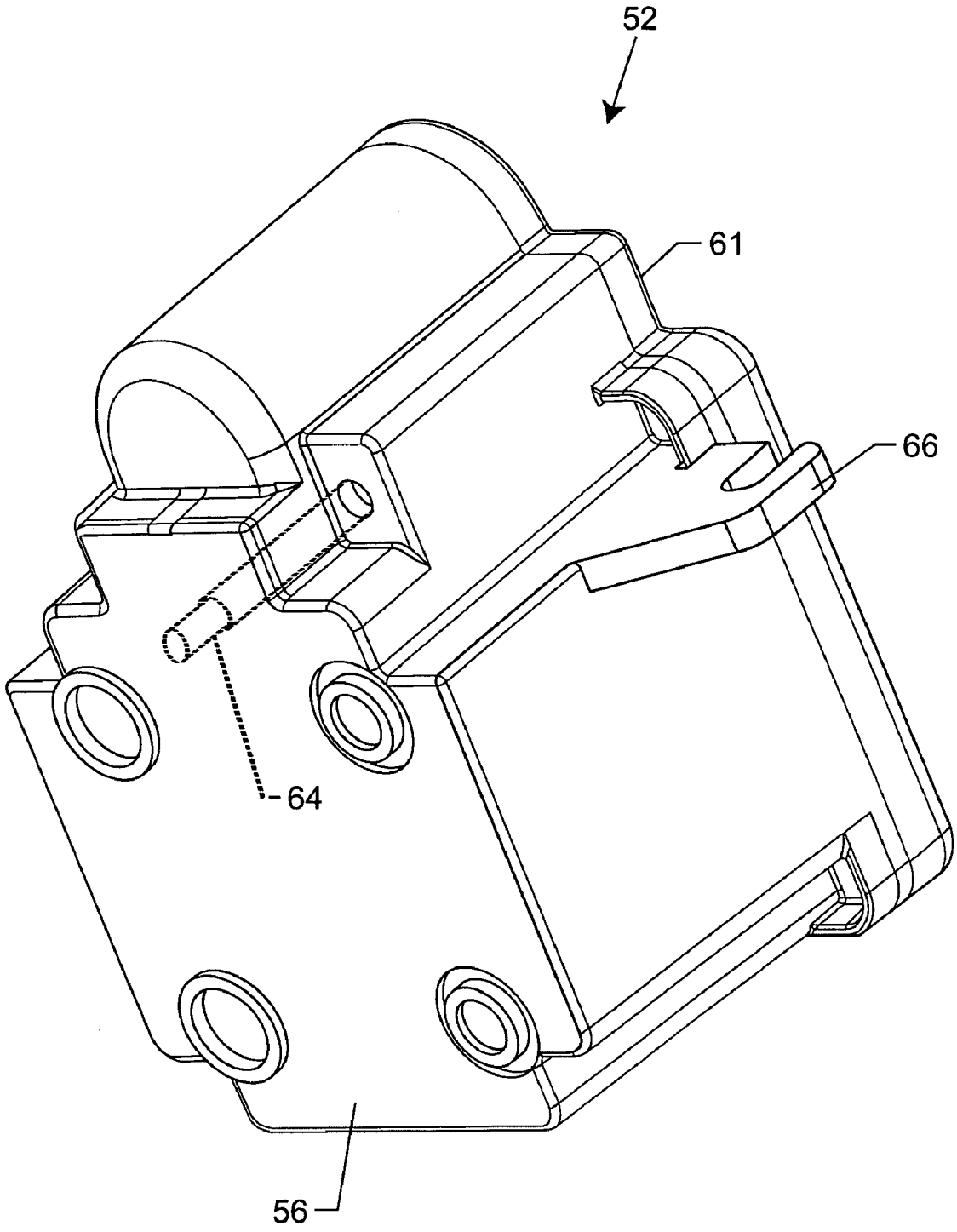
FIG. 12 is an inboard side perspective view of the drive motor shown in FIG. 11.
Figure 13:
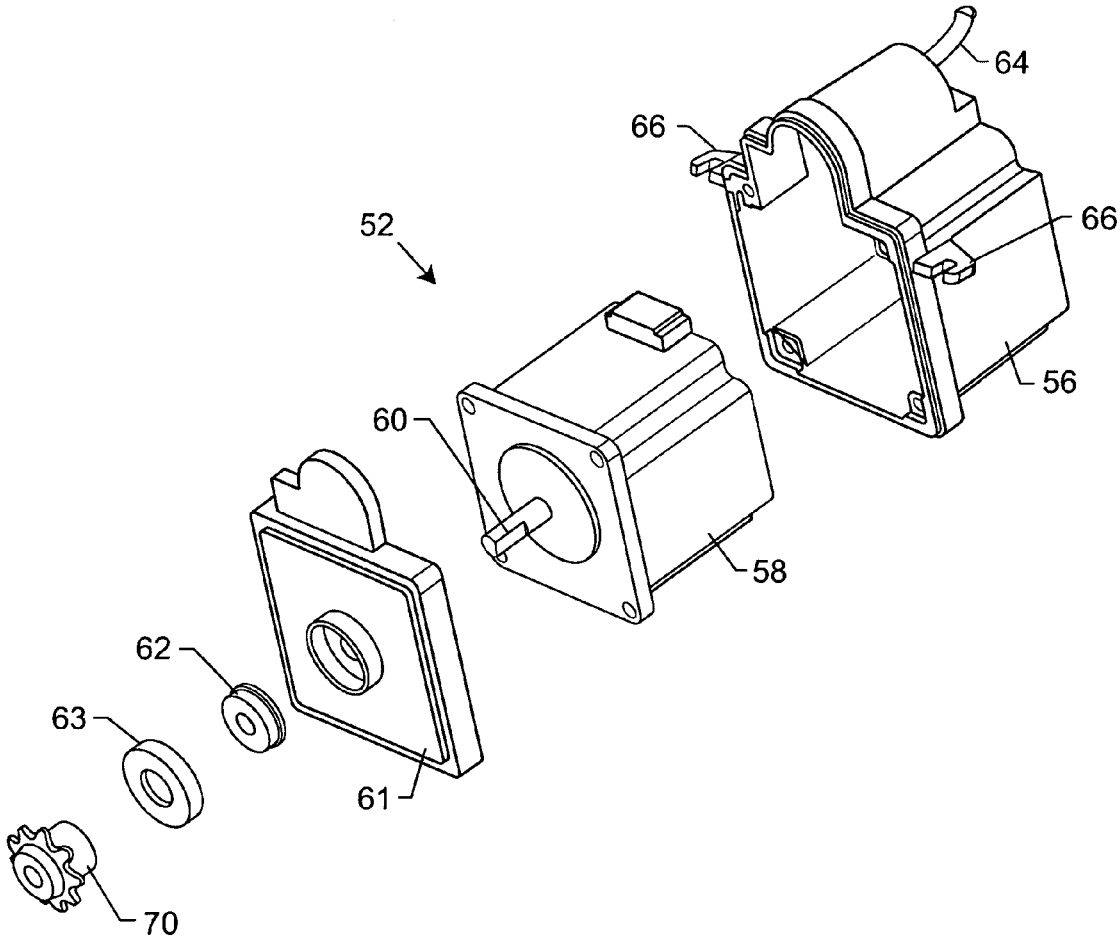
FIG. 13 is an exploded outboard side perspective view of the drive motor shown in FIGS. 11-12.

The external housing 12 is formed from upper and lower housing shells 36 and 38 each formed from a lightweight molded plastic or the like and adapted for quick and easy mounting onto and disassembly from an internal frame 40 (FIGS. 7 and 10). These upper and lower housing shells 36, 38 are removably mounted onto the internal frame 40 by means of screws (not shown) or the like, for normally and substantially enclosing and encasing the electric-powered drive system 18 and the electric-powered pump 20, as will be described in more detail. When and if required, one or both of these housing shells 36, 38 can be disassembled from the internal frame 40 for convenient access to internal cleaner components, i.e., for repair and/or replacement.

As shown in the exemplary drawings in accordance with one preferred form of the invention, electric power for operating the cleaner 10 is provided via the power cable 28 shown connected by a releasible coupling 42 (FIGS. 7-9) to a fitting 44 at an upper end of a power mast 46 which extends upwardly through the upper housing shell 36 at a location spaced a short distance behind the suction mast 22. As viewed in FIG. 6, this power cable 28 extends from the pool cleaner 10 to a deckside or dry-site location disposed outside the pool 14, whereat the power cable 28 is suitably connected to a power supply 48. In this regard, the power supply 48 desirably comprises a stationary or fixed position, i.e., non-portable power-supply module that is securely and safely anchored in place at a dry site location, as by secure and substantially permanent attachment to a dry-site wall structure 50 or the like. With this construction, the non-portable power supply 48 is not mounted on a portable or movable structure such as a portable wheeled cart, and thus cannot be inadvertently dragged or knocked or otherwise dropped into the pool water. The releasible coupling 42 at the cleaner end of the power cable 28 accommodates disconnection of the cleaner 10 for facilitated handling outside the pool, e.g., in course of repair or maintenance.

Figure 8:
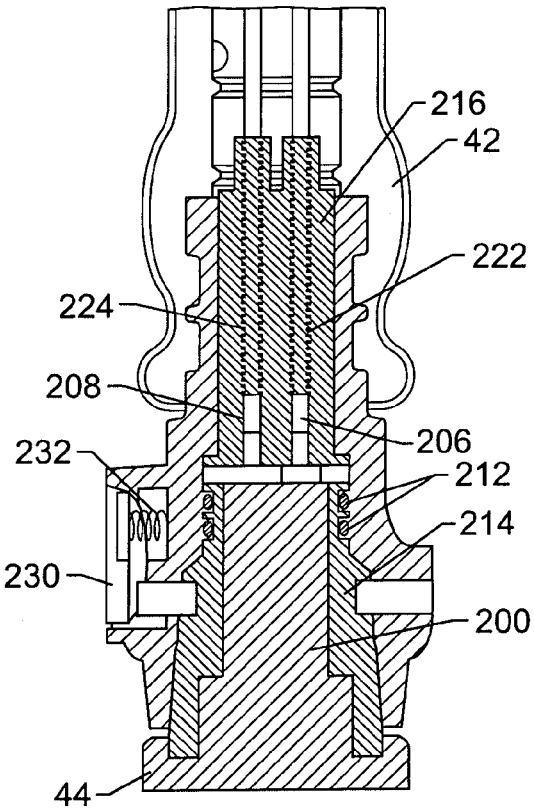
FIG. 8 is an enlarged fragmented vertical sectional view corresponding with a portion of FIG. 7, and showing a power cable coupled to a pool cleaner power mast.
Figure 9:
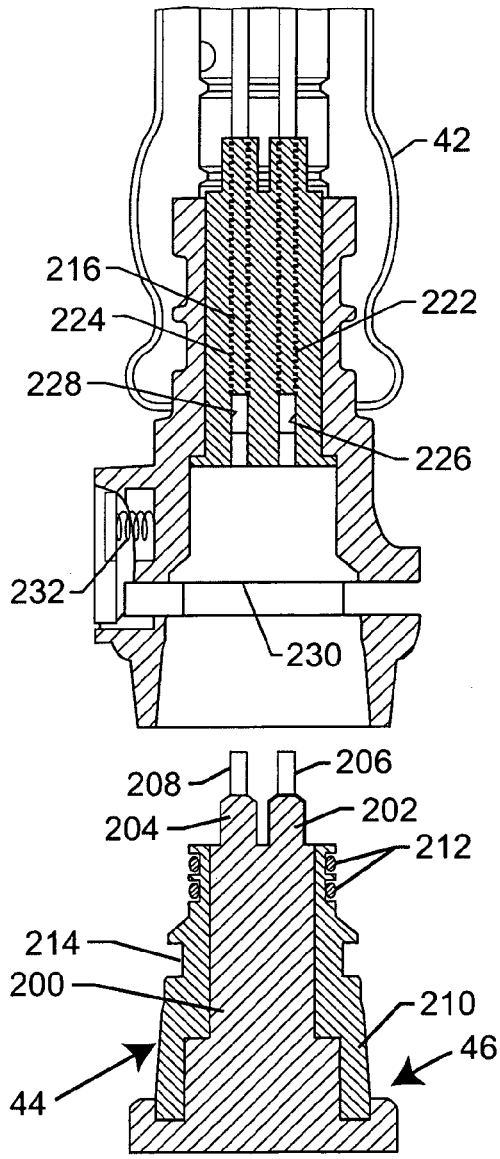
FIG. 9 is an enlarged fragmented, and exploded vertical sectional view similar to FIG. 8, but showing the power cable disconnected from the pool cleaner power mast.

As shown best in FIGS. 8-9, the power cable fitting 44 at the upper end of the power mast 46 comprises, in the illustrative preferred embodiment of the invention, a male component of a male-female hermetically sealed coupling assembly. As shown, the fitting includes an over-molded insulation jacket 200 carrying a pair of insulated conductors 202, 204 which respectively terminate in conductive pins 206, 208 which project upwardly a short distance from a male fitting collar 210. At least one and preferably multiple seal rings 212 such as elastomeric O-ring seals are carried about the collar 210 at a location spaced a short distance above a radially outwardly open lock groove 214 formed in the collar 210.

The counterpart coupling 42 is mounted at the free end of the power cable 28, and comprises a female component of the male-female water-tight coupling assembly. As shown, the coupling 42 comprises an insulated jacket 216 having the free end of the power cable 28 securely connected thereto in a leak-free manner, with a pair of cable conductors 218, 220 suitable connected within the coupling 42 to a pair of terminal pins 222,224 positioned for electrical conductive seated contact with the conductive pins 206, 208 on the power mast fitting 44. As shown, these terminal pins 222, 224 are exposed within a corresponding pair of recessed sockets 226, 228 (FIG. 9) having a size and shape for plug-in reception of the power mast fitting pins 206, 208. An open or distal end of the female coupling 42 is sized and shaped for slide-fit reception of the male fitting 44, with the seal rings 212 pressed and sealed in hermetically sealed engagement with an inboard wall surface of the female coupling 42. A laterally slidable lock key 230 carried by the outer female coupling 230 normally engages the lock groove 214 on the male fitting 44 to prevent axial separation of the coupling components. The lock key 230 can be depressed against a spring 232 to release or separate from the lock groove 214 to permit component separation, when and if desired. Further details of this releasible lock mechanism are shown and described in U.S. Pat. Nos. 4,436,125; 4,541,457 and 5,316,041, which are incorporated by reference herein.

Although the exemplary embodiment of the invention depicts the power cable 28 tethered to the pool cleaner 10 by means of the quick-connect, quick-disconnect coupling 42 and fitting 44 for connecting the pool cleaner to a dry-site power supply 48, persons skilled in the art will recognize and appreciate that alternative power supply arrangements may be used including, but not limited to, a rechargeable battery power supply mounted on-board the pool cleaner 10.

As shown best in FIGS. 4 and 10-13, the electric-powered traction drive system 18 comprises a pair of substantially sealed electric drive motors 52 mounted within the cleaner housing 12 on the internal frame 40 of the pool cleaner 10. These drive motors 52 preferably comprise a pair of stepper motors mounted on the frame 40 in side-by-side relation respectively at the right and left sides of the frame for respectively driving the wheels at the right and left sides of the pool cleaner. More particularly, one drive motor 52 at the right side (as shown in the illustrative drawings) of the frame 40 is drivingly coupled to the right-side pair of cleaner wheels 15 and 16, as by direct-drive coupling to the front wheel 15 which is coupled in turn by the traction tread 31 to the rear wheel 16. By contrast, the other drive motor 52 is drivingly coupled to the left-side cleaner wheel 17. Importantly, and as will be described in more detail, the two drive motors 52 are independently regulated by a common controller or processor 54 (FIGS. 4 and 7) for regulating the direction and speed of cleaner travel.

Each of the drive motors 52 includes a generally cup-shaped housing 56 base adapted for slide-fit reception of a drive motor unit 58 (FIG. 13) having an outwardly protruding drive shaft 60. A housing cap 61 is assembled with the housing base 56 to define a substantially hermetically sealed housing enclosure, with the drive shaft 60 protruding outwardly through a sealed bearing assembly including a bearing ring 62 and a thrust cap 63. A suitable power cord 64 is coupled through the housing base 56 to the motor unit 58, with an appropriate port or passage sealed with potting compound or the like. The thus-assembled drive motor 52 is mounted onto the internal frame 40 at predetermined mounting positions as by means of screws 65 (FIG. 10) extending through associated ported flanges 66 on the housing base 56 and fastened securely into pre-formed bosses or the like on the internal frame 40. In the preferred geometry, the two drive motors 52 are mounted in side-by-side relation on an upper side of the internal frame 40 near the front thereof, with their respective drive shafts 60 extending laterally outwardly in opposite directions, at opposite sides of the frame 40, and in generally coaxial relation.

The outboard ends of these drive shafts 60 each carry an associated drive sprocket 70, as shown in FIG. 10. Each drive sprocket 70 comprises a toothed sprocket wheel (FIG. 13) adapted for engaging and driving one or a pair of sprocket chains 72 and 74 (FIG. 10) used for respectively driving the right-side wheels 15 and 16, and the left-side wheel 17 of the pool cleaner 10. In this regard, a relatively large diameter driven sprocket 76 is carried at an inboard side of each of the driven wheels 15 and 17 (FIG. 10), normally concealed within the associated housing cowlings 19. FIG. 10 shows the right-side sprocket chain 72 engaged with the drive sprocket 60 of the right-side drive motor 52, and further engaged with the driven sprocket 76 at the inboard side of the right-side front wheel 15. However, again, it will be understood that the right-side chain 72 may also be engaged with a driven sprocket at the inboard side of the rear wheel 17, in lieu of the traction tread 31 as shown. In either case, the right-side drive motor 52 drivingly rotates at least one and preferably both of the right-side wheels 15 and 16 in a common rotational direction. FIG. 10 also shows the left-side sprocket chain 74 engaged with the associated left-side drive sprocket 60 and also engaged with the driven sprocket 76 at the inboard side of the left-side wheel 17.

Further details relating to the rotational mounting of the cleaner wheels 15, 16 and 17 relative to the internal frame 40, as well as further details directed to the connection of the sprocket chains 72, 74 with the associated right-side and left-side drive and driven sprockets 70, 76 may be found in U.S. Pat. No. 6,665,900, which is incorporated by reference herein.

In accordance with one aspect of the invention, the control processor 54 is carried on-board the pool cleaner and is appropriately coupled to the power source as by means of the illustrative power cable 28 or the like. As depicted schematically in FIG. 4, the processor 54 separately and independently regulates the two drive motors 52 for correspondingly regulating the forward or reverse-drive directions and speeds of the right-side wheels 15 and 16 relative to the left-side wheel 17 in a separate and independent manner. By way of example, during normal cleaner operation to traverse submerged pool surfaces, the processor 54 will operate the two drive motors 52 for driving the right-side and left-side wheels in a forward direction and at a common rotational speed to achieve substantially straight-ahead cleaner travel. Alternately, the processor 54 may operate the drive motors in a forward direction but at somewhat different rotational speeds to achieve forward cleaner travel with a selected right or left turning motion. As a further alternative, the processor 54 may operate the drive motors 52 in a reverse-drive mode at a common or different rotational speeds to achieve straight-reverse or turning-reverse cleaner travel. Still further, the processor 54 may operate the one drive motor in a forward-drive mode and the other drive motor in a reverse-drive mode to execute a turning maneuver substantially without forward or reverse cleaner travel. The processor 54 can be programmed to operate the drive motors 52 in a succession of these different modes, and for predetermined times applicable to each mode. The specific programmed operation of the processor 54 may vary according to the specific performance criteria associated with any particular swimming pool within which the pool cleaner 10 is used. In addition, the processor 54 may control the drive motors 52 for relative slow and smooth acceleration and decelerations movements thereby providing smooth and controlled cleaner travel over submerged pool surfaces with improved steering and stability, and substantially without lifting of the cleaner (i.e., without performing "wheelies") relative to the underlying pool surface. In addition, such smooth acceleration and deceleration effectively prolongs the anticipated service life of the drive motors and related moving components.

Figure 5:
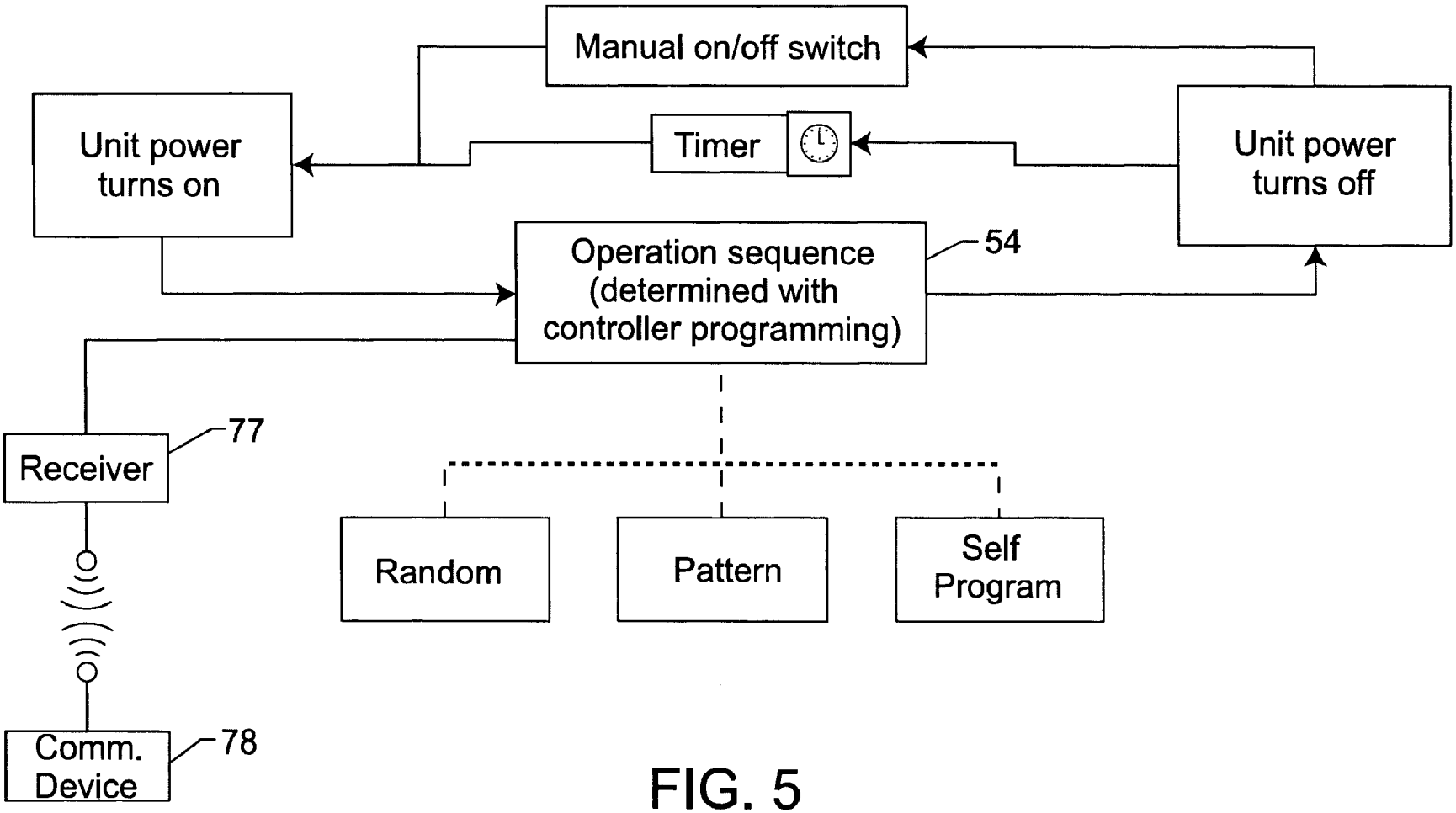
FIG. 5 is a flow chart illustrating operation of the pool cleaner within a swimming pool.

FIG. 5 is a schematic flow chart showing, in general terms, this multi-directional programmed operation of the pool cleaner 10, under control of the processor 54. As shown, when the unit is turned on manually or in response to timed on-off operation, the processor 54 operates the drive motors 52 in accordance with a predetermined or pre-programmed or self-programmed operational sequence. By way of illustrative example, the processor 54 may be programmed to drive the cleaner 10 through a succession of forward and reverse steps each of predetermined duration with intervening turns of preselected magnitude, to achieve an overall programmed pattern of movement whereby the cleaner 10 traverses and thus cleans substantially the entire submerged surface area of the associated pool 14, all in a manner that does not produce excess or undesired twisting of the power cable 28. Alternately, the processor 54 may be programmed to allow the cleaner 10 to proceed generally in a forward direction, with periodic reverse or reverse-turning movements, thereby substantially preventing the cleaner 10 from becoming trapped or stuck in any small region of the pool, such as a corner or adjacent steps, etc., thereby also minimizing wear and tear on the pool surface coating as well as cleaner wear and tear associated with the cleaner becoming stuck or trapped. As a result, the processor 54 provides for cleaner travel to traverse submerged pool surfaces in a substantially random overall pattern of travel. In this alternative random travel embodiment, the directional control system 26 provides an important input to the processor 54 which can respond to excessive twisting of the power cable 28 by turning the cleaner in a manner to un-twist the power cable.

As another alternative, the control processor 54 can be designed and programmed, in conjunction with the directional control system 26, for monitoring actual pool cleaner vector movements in the course of initial operation for self-program development of a memory map reflecting actual pool geometry, and thereafter control pool cleaner movements according to a programmed pattern developed from or selected in accordance with the memory map. The thus custom-selected programmed pattern may be developed internally by the processor 54, or selected from a plurality of patterns pre-programmed in a processor database memory, or alternately inputted to the control processor by means of a suitable wireless transmission data link. FIG. 5 shows the control processor to include a receiver 77 for use in remote wireless communication with a suitable remote communication device 78, such as a transmission/receiver device or the like positioned outside the pool 14 and adapted for preferably bi-directional communication with the control processor 54 via the receiver 77 as by means of suitable wireless information transmission technology. In this regard, the remote communication device 78 may comprise a computer or personal data assistant, or the like, and further may be designed or adapted for compatibility with a pool equipment control system such as the pool control system available from Polaris Pool Systems, Inc., Vista, Calif. under the product name Eos. Other wireless communications systems may be used, including but not limited to global positioning systems (GPS).

The directional control system 26 includes the on-board compass 27 for monitoring the actual direction of travel and accumulated turning movements of the pool cleaner 10 within the pool 14, and for signaling this information to the processor 54 which programmably responds by appropriate drive motor operation to regulate subsequent cleaner movements. The compass 27 is mounted on the cleaner 10 preferably at a visible position such as at an elevated position on the upper housing shell 36 generally aft of the suction mast 22 (FIGS. 1-2 and 7). The illustrative compass 27 comprises a generally ball-shaped compass housing 80, wherein at least an upper housing member 82 of the compass housing 80 is formed from a transparent or partially transparent material to permit external observation of compass components contained therein. This ball-shaped compass housing is substantially sealed, with the interior thereof defining a substantially or predominantly hollow compass chamber, whereby the compass housing 80 also functions effectively as a ballast float disposed above and behind a center of gravity of the pool cleaner. As is known in the art, this ballast float assists in orienting the pool cleaner 10 so that it will land upon the pool floor 30 in an upright orientation with the cleaner wheels engaging the pool floor. The ballast float additionally assists in turning the cleaner around when climbing and subsequently descending substantially vertically oriented pool walls 32, resulting in a fast and effective overall cleaning pattern.

Figure 14:
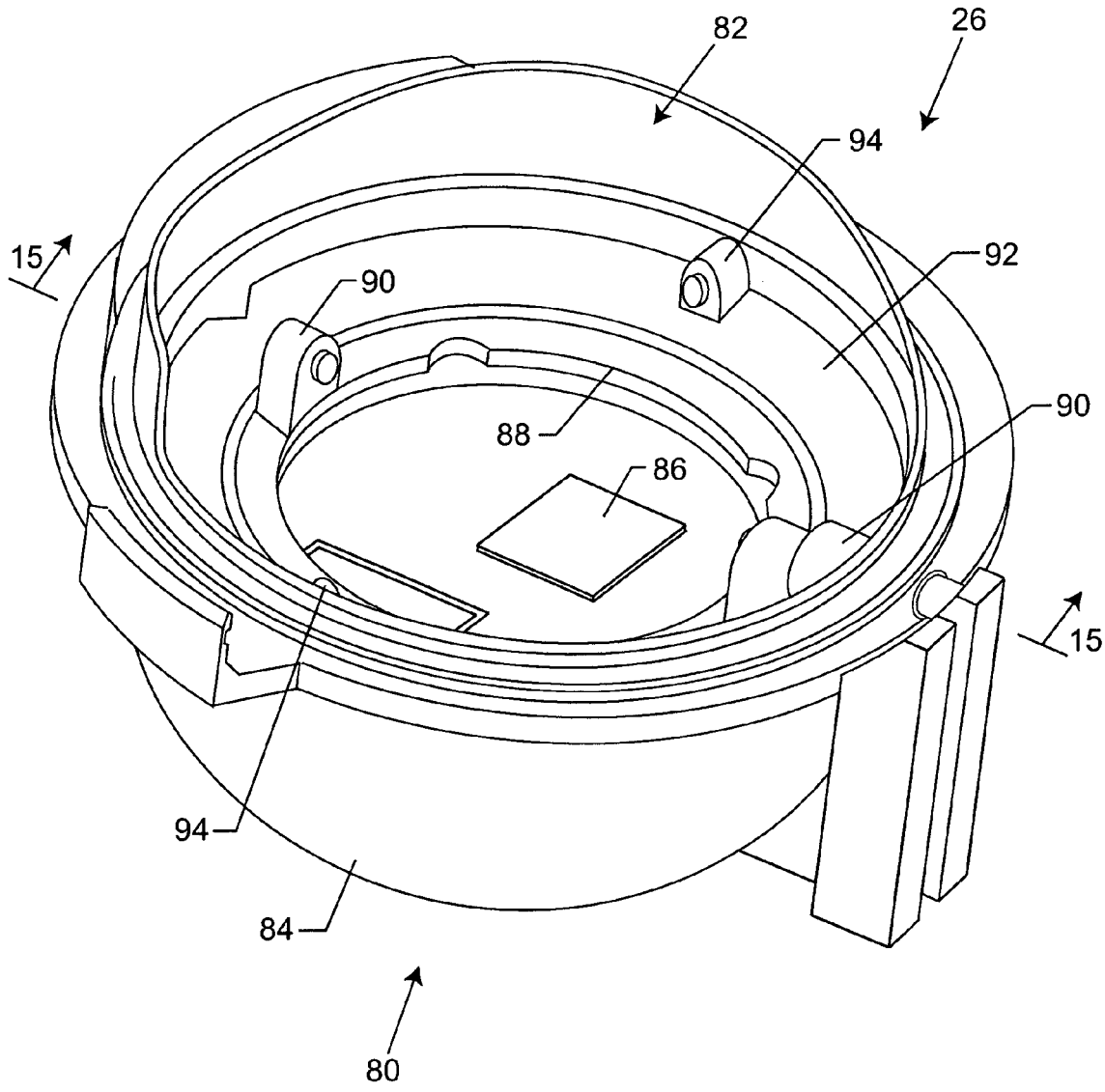
FIG. 14 is a top perspective view of a compass unit forming a portion of the directional control system shown in FIG. 4.
Figure 15:
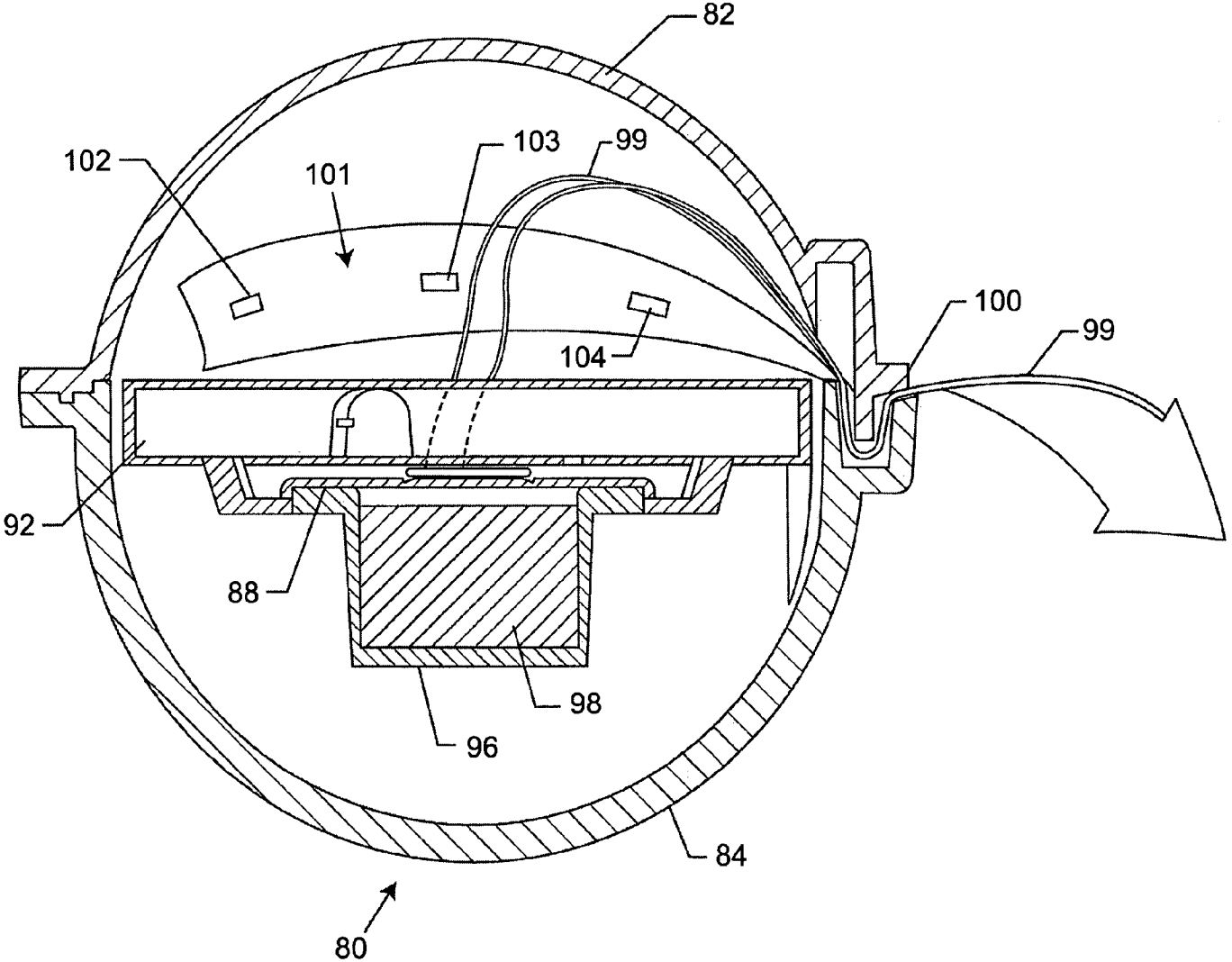
FIG. 15 is a vertical sectional view taken generally on the line 15-15 of FIG. 14.
Figure 16:
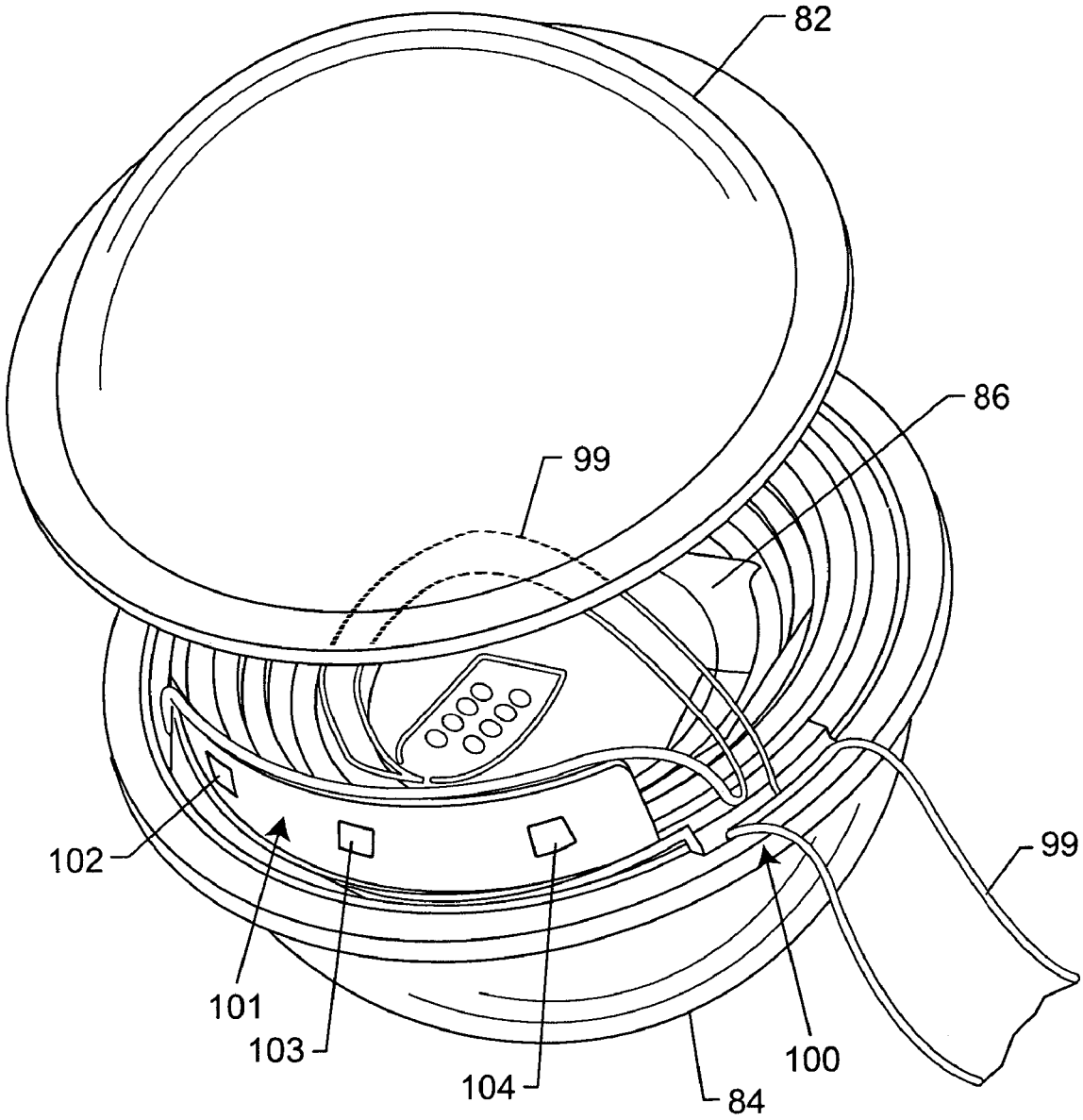
FIG. 16 is an exploded rear perspective view of the compass unit of FIGS. 13-14.

The compass 27 is shown in more detail in FIGS. 14-16. As shown, the compass housing 80 includes the transparent (or translucent) upper housing member 82 of generally hemispherical shaped assembled with a matingly shaped lower housing member 84 to define the generally ball-shaped geometry. These compass housing members are sealed by any suitable means, including but not limited to an ultrasonic weld, and/or suitable potting compound or adhesive material, or by a suitable snap-fit or screwed together construction including appropriate gaskets. The lower compass housing member 84 can be adapted for attachment to, or may be formed integrally with the upper housing shell 36. An electronic compass is embodied on a circuit board 86 or the like which is gimbal-mounted within the compass housing 80 so that the circuit board 86 (and compass carried thereon) remains substantially in a horizontally level orientation as the cleaner 10 travels throughout the pool 14. The gimbal mount is shown to include an inner support ring 88 carrying the circuit board 86 and pivotally mounted by a pair of pivot pins 90 on an outer support ring 92 which is pivotally mounted in turn by a pair of pivot pins 94 on the lower housing member 84. As shown, the pairs of pivot pins 90 and 94 are disposed substantially in a common plane, and respectively support the components for pivot movement on axes disposed at right angles to each other. The inner support ring 88 includes a depending central cup segment 96 (FIGS. 16-17) within which a relatively heavy mass or weight 98 is carried to urge the circuit board 86 (and electronic compass thereon) toward a normal substantially horizontal orientation.

Figure 4:
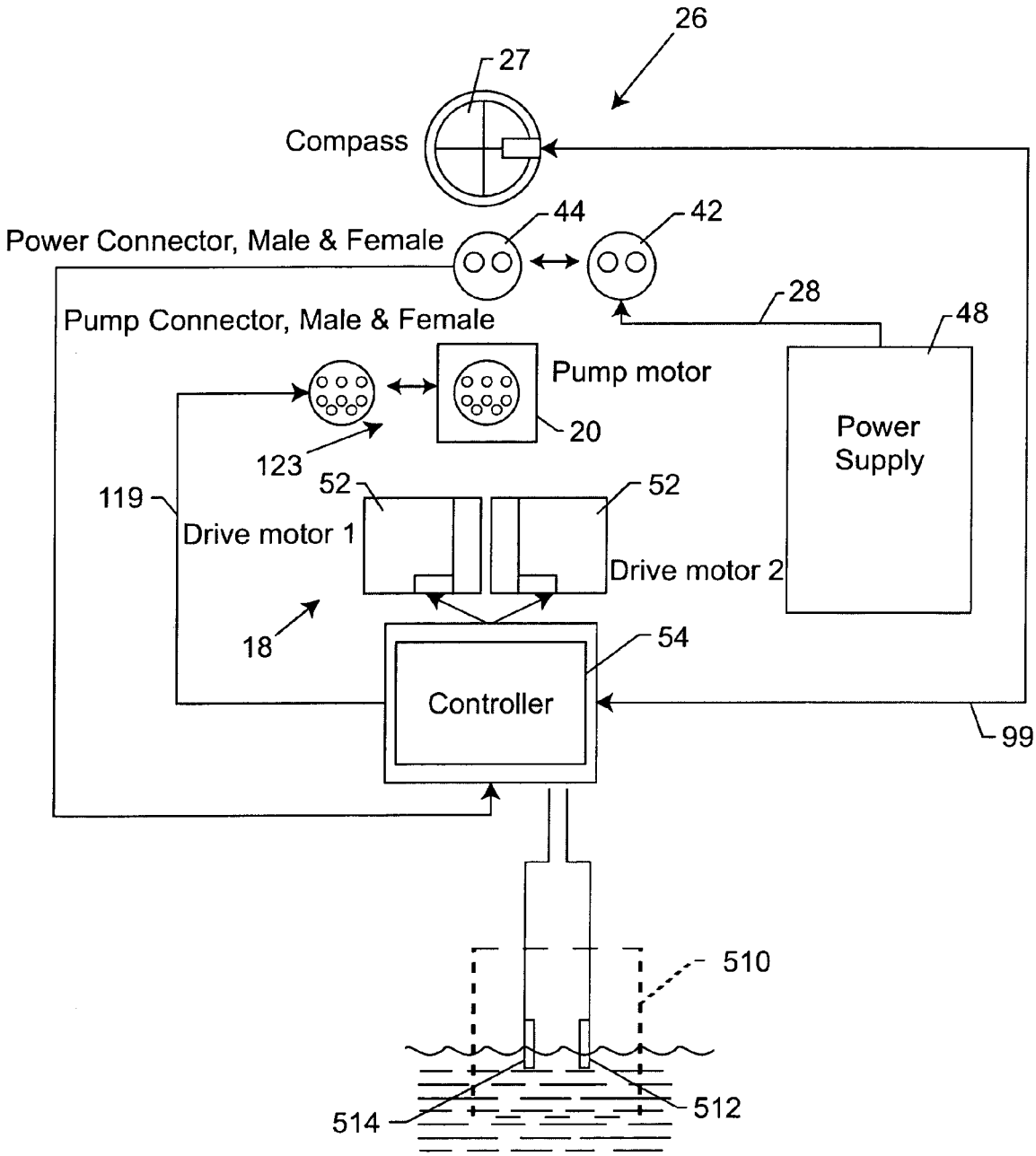
FIG. 4 is a schematic diagram illustrating a preferred directional control system for use with the pool cleaner shown in FIGS. 1-3.

The circuit board 86 is coupled to electric power by means of a relative thin and highly flexible flex circuit strip 99 (FIGS. 15-16) attached at one end to the circuit board 86, and looped in an elongated strain relief configuration within the compass housing 80 prior to attachment of an opposite end through a sealed joint 100 formed between the upper and lower housing members 82, 84. The flex circuit 99 is suitably connected in turn to the processor 54 (FIG. 4). Importantly, the strain-relief configuration of the flex circuit 99 substantially avoids imposition of any significant force that could otherwise limit or restrict movement of the gimbal-mounted circuit board. One preferred material for use in forming the flex circuit 99 comprises Kapton. Alternately, it will be understood that the electronic compass may be formed directly on a portion of the flex circuit 99 within the compass housing 80 and positioned on the gimbal mount for directional-caused movement, in lieu of the separate circuit board 86 as shown in the exemplary drawings.

Within the compass housing 80, the flex circuit 99 further includes a second branch 101 coupled to and/or carrying one or more signal lights, such as the illustrative trio of LED's 102, 103 and 104 supported within the compass housing for external, preferably rearward visibility (FIG. 16) through the transparent upper housing member 82. In accordance with one preferred form of the invention, these LED's comprise indicator lights powered by the processor 54 for providing an externally visible indication of cleaner status and/or operation. By way of example, the center LED 103 may be illuminated red to indicate power-on status. This center LED 103 may also be programmed for indicating a variety of fault conditions, as by intermittent or flashing operation to distinguish from continuous illumination to indicate normal operation. The left-side and right-side LED's 102 and 104 may be illuminated in other colors, such as blue and green, respectively, to indicate directional twisting of the power cable 28.

Directional signals from the compass 27 may be monitored and accumulated by the processor 54 in a manner indicating excess twisting of the power cable 28 in either rotational direction, wherein such excess twisting can undesirably apply a drag force on the pool cleaner 10 to restrict or inhibit random or programmed cleaner travel over submerged pool surfaces. By way of example, the directional signals from the compass 27 to the processor 54 enable to processor to identify the direction and magnitude of each turning movement of the pool cleaner, irrespective of whether such turning movement is the result of programmed operation of the drive motors 52, or alternately the result of the normal cleaner travel over shaped and contoured submerged surfaces, and into engagement with side walls, corners, steps, etc. In the event that the cleaner 10 undergoes a sequence of turning motions that result in twisting of the power cable 28 more than a predetermined number of turns in either rotational direction (e.g., such as more than about 1½ turns in either direction), relative to an untwisted configuration, the processor 54 can be programmed for operating the drive motors 52 in a manner to untwist the power cable, as operating the drive motors 52 for rotatably driving their associated wheels in opposite directions to untwist the power cable 28, before resuming normal cleaner operation. This untwist operation is shown best in FIG. 6, with double-headed arrow 112 indicating processor-controlled drive motor operation to turn the pool cleaner 10 sufficiently to untwist the power cable 28.

FIGS. 7 and 17-23 depict a water management system including the electric-powered pump 20 and a related manifold unit 114 for providing a supply of water under pressure to pool cleaner components such as the suction mast 22. As shown, the pump 20 comprises an electric motor 116 (FIG. 19) encased within a substantially hermetically sealed pump housing including a generally cup-shaped housing base 118 and a sealed cap 120 having seal rings 121 engaged with and supporting a sealed coupling 123 connected in turn with a power cord 119 connected (FIG. 4) with the processor 54. The pump motor 116 has a downwardly directed drive shaft 122 for rotatably driving an impeller 124. In the preferred form as shown, the drive shaft extends axially through a seal ring 125 and associated cover ring 126 for connection to the impeller 124 by means of suitable retaining ring 117 or the like.

Figure 21:
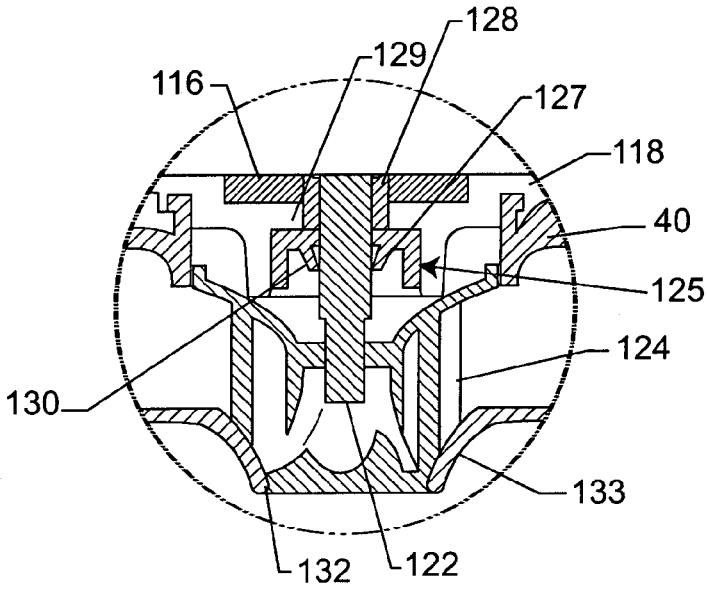
FIG. 21 is an enlarged and fragmented vertical section view corresponding generally with the encircled region 21 of FIG. 20.
Figure 23:
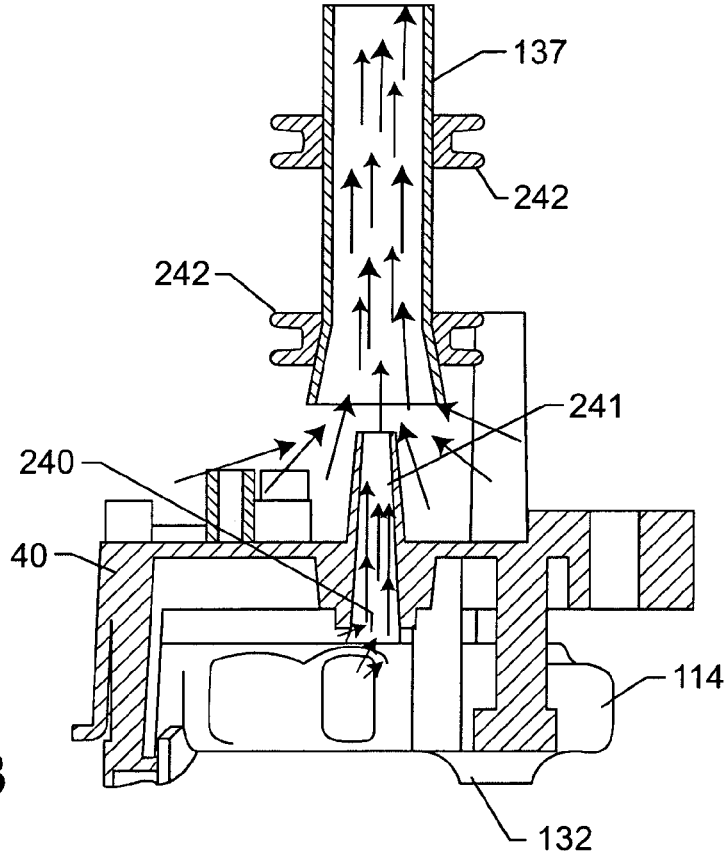
FIG. 23 is an enlarged and fragmented vertical sectional view depicting a thrust jet forming a portion of the water management system.

The seal ring 125 is shown in more detail in FIG. 21 to incorporate a generally Y-shaped double lip configuration, with a pair of axially spaced-apart resilient lips 127 engaging the drive shaft 122 at the outboard side of a port 129 in the housing base 118. This double lip seal configuration beneficially provides a primary seal function preventing undesired water intrusion along the drive shaft 122 into the interior of the pump housing. A water-insoluble lubricant such as a silicon-based grease-type lubricant is preferably contained within a small chamber 130 between the seal lips 127, thereby providing enhanced sealing against water leakage along surface imperfections of the drive shaft 122.

In the event of water intrusion past the seal ring 125, as may occur due to seal wear over an extended operating life cycle, additional seal components and structures provide back-up sealing to protect the drive motor 116 against water contact and damage. For example, an annular pocket 128 is formed at an inboard side of the seal ring 124, wherein this pocket 128 is also filled with a water-insoluble lubricant such as a silicon-based grease-type lubricant to block water intrusion. Accordingly, this grease-filled pocket 128 provides a secondary stage of pump motor protection. In the event of failure of this secondary stage seal protection, the pump motor 116 includes motor elements such as a rotor 180, field coils 182, and a control board 184 each encased within a suitable potting compound 185 defining a tertiary seal stage for protection against water intrusion and damage. These sealed components 180, 182 and 184 cooperate with waterproof bearings 186, such as stainless steel bearings, supporting the drive shaft 122, for prolonging pump motor operating life in the submerged swimming pool operating environment.

Accordingly, in the preferred form as shown, the pump 20 incorporates a succession of seal components and structures each designed to protect the pump motor 116 against water intrusion damage, and wherein these seal components and structures effectively function in series to provide a greatly extended pump service life.

Figure 17:
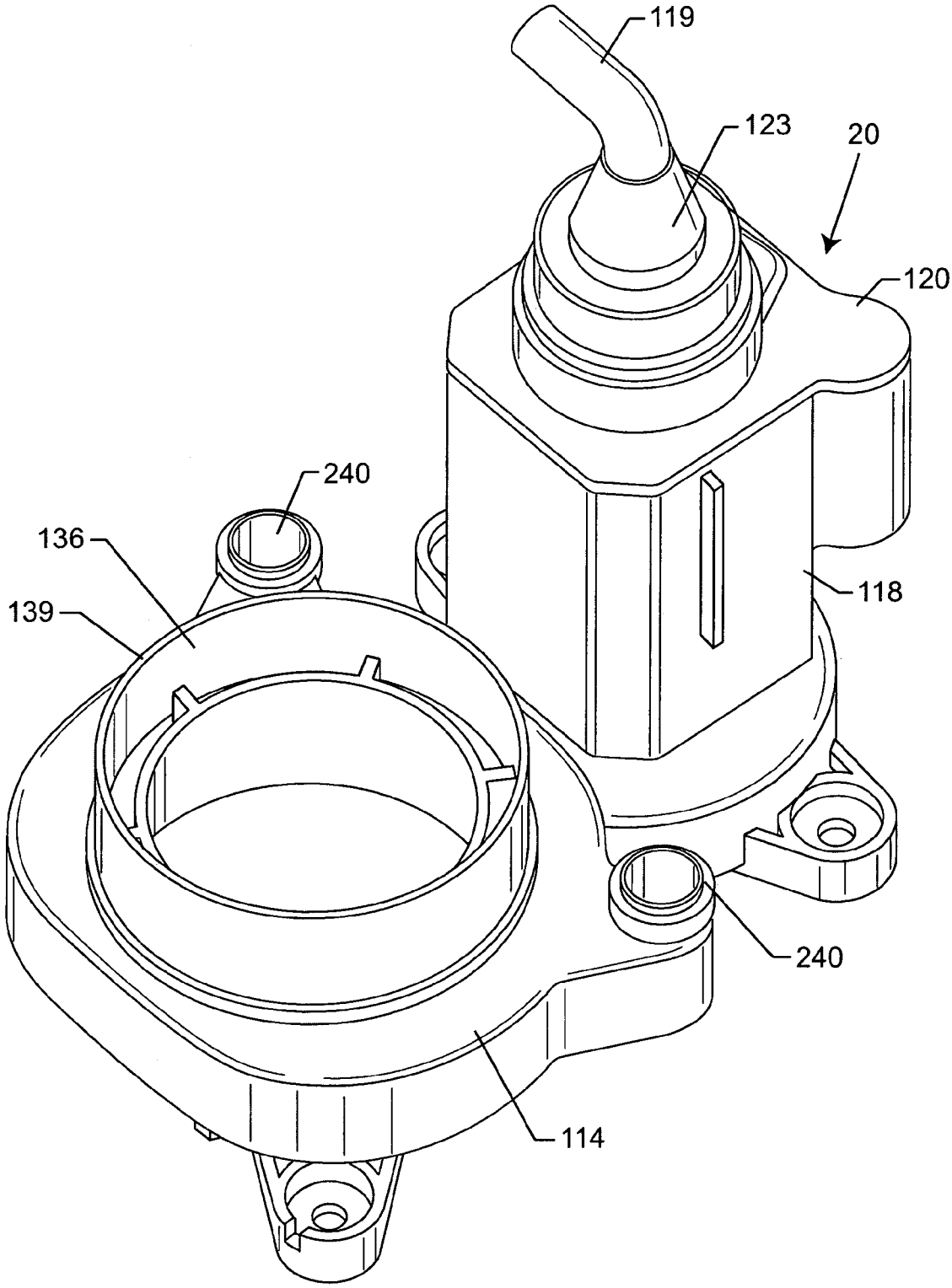
FIG. 17 is an enlarged top perspective view showing a water supply pump and manifold unit forming a portion of the water management system, in accordance with one preferred form of the invention.
Figure 18:
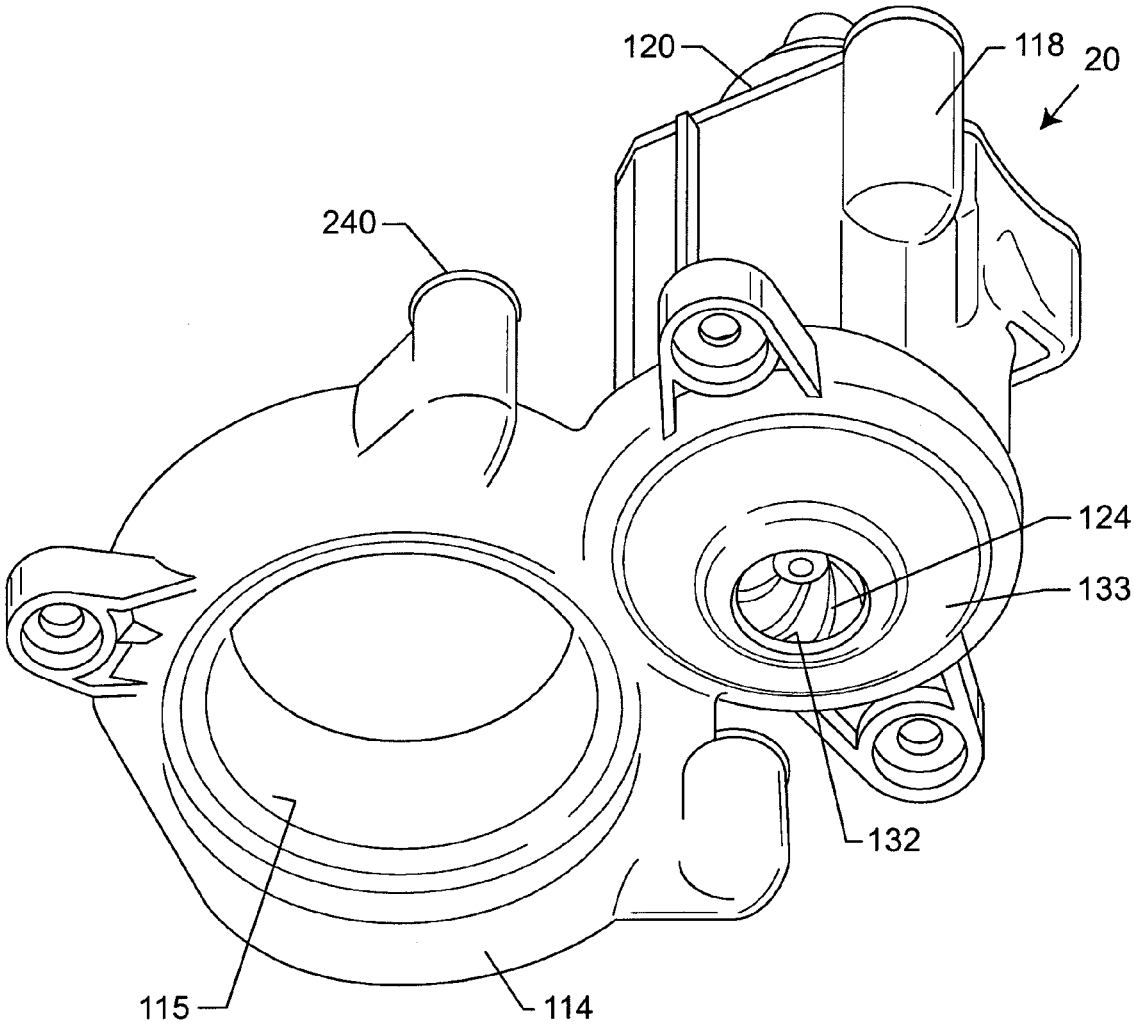
FIG. 18 is a bottom perspective view of the water supply pump and manifold unit of FIG. 17.
Figure 22:
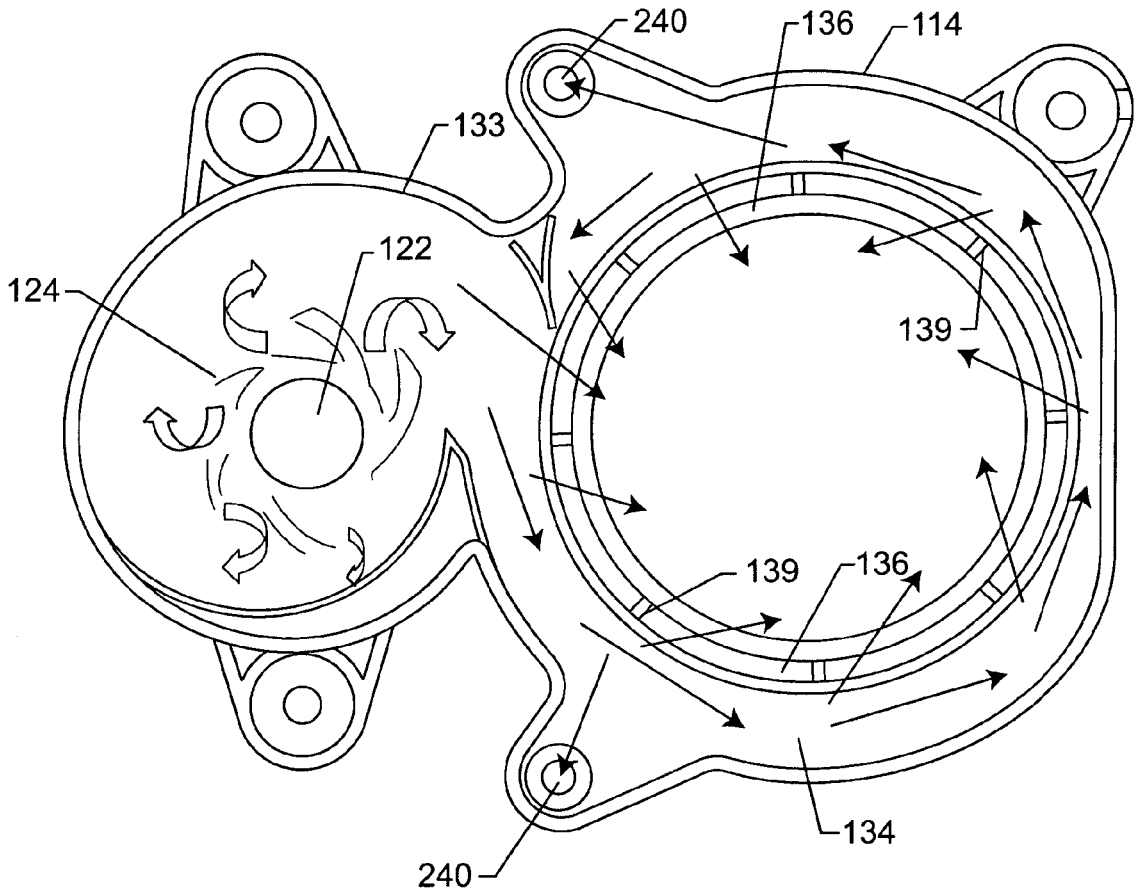
FIG. 22 is an enlarged horizontal sectional view taken generally on the line 22-22 of FIG. 20.

The impeller 124 as shown in the exemplary drawings is designed for drawing a flow of water axially upwardly through an inflow port 132 (FIGS. 18 and 20-21) defined by a manifold housing 133 of the manifold unit 114 within the interior of the cleaner housing 12, and for discharging a water outflow under pressure in a radially outward direction into an annular pressure or plenum chamber 134 (FIG. 22) also defined by the manifold unit housing 133. In this regard, the manifold unit 114 has a size and shape, and is mounted in a position for orienting the plenum chamber 134 in a position generally circumferentially surrounding a lower end of the suction mast 22 (FIG. 20) which has an open lower end exposed through a vacuum plate 140 carried by the lower housing shell 38 to the underside of the pool cleaner 10, and an open upper end extending through the upper housing shell 36 for carrying the filter bag 24. FIGS. 17 and 22 show a narrow annular jet nozzle 136 defined by the manifold unit 114 to provide an upwardly and inwardly angled jetted flow of water within the suction mast 22 near the lower end thereof, thereby creating a venturi action that draws water upwardly from beneath the pool cleaner and through the suction mast into the filter bag. This venturi action, effectively sweeps or vacuums dirt and debris settled onto a submerged pool surface underlying the pool cleaner upwardly through the suction mast 22. Anti-swirl vanes 139 may be incorporated into the annular jet nozzle 136 at periodic circumferential intervals for improved upward jet flow, substantially without significant circumferential swirling.

As shown (FIG. 20), for substantially optimized venturi action, the vacuum plate 140 defines a tapered intake opening 141 which merges smoothly with a similarly tapered inboard wall 115 of the manifold housing 133, wherein an upper margin of this tapered housing wall 115 defines a radially inboard margin of the annular jet nozzle 136. With this narrowing tapered construction, water flow and entrained debris is drawn upwardly into the suction mast 22 with an accelerating action.

The filter bag 24 (FIG. 1) comprises a porous bag construction designed to entrap and collect water-entrained dirt and debris vacuumed upwardly through the suction mast, while permitting the water flow to pass through the bag and return to the body of water within the pool. Although the specific design and construction, and method of mounting the filter bag 24 onto the suction mast 22 may vary, preferred bag constructions and mounting methods are shown and described in detail in U.S. Pat. Nos. 4,618,420; D288,373; 4,575,423; D294,963; 4,589,986; 5,863,425; D409,341; D468,067; 6,740,233; and 6,908,550, all of which are incorporated by reference herein.

The manifold unit 114 further includes at least one and preferably a pair of upwardly directly thrust tubes 137 (FIGS. 1-2, 10, and 23) extending upwardly through the internal frame 40 and an aligned aperture 138 (FIG. 2) formed in the upper housing shell 36. These thrust tubes 137 provide upwardly directed jets of water emanating from the pool cleaner 10 generally at opposite sides of the suction mast 22, to produce corresponding reaction forces acting downwardly upon the cleaner. These downward reaction forces beneficially urge the cleaner wheels into improved traction drive engagement with the underlying pool surface, for improved traction drive operation.

FIGS. 17 and 22 shows a pair of upwardly directed thrust jet ports 240 on the manifold unit 114, in flow communication with the pressure or plenum chamber 134, and at locations disposed on opposite sides of the suction mast 22 generally at a rear side thereof. These thrust jet ports 240 provide a corresponding pair of upwardly directed jet flow outputs. As viewed in FIG. 23, these jet flow outputs from the thrust jet ports 240 are directed respectively through a corresponding pair of jet nozzles 241 formed on the internal frame 40 which in turn accelerate and direct the jet flow outputs upwardly into the lower ends of the thrust tubes 137. The thrust tubes incorporate enlarged or flared lower ends, and have one or more external mounting flanges 242 for convenient secure mounting to adjacent cleaner structures with the flared lower ends spaced a short distance above the underlying jet nozzles 241 aligned therewith. With this construction, the upwardly jetted water through the nozzles 241 draws by venturi action additional water within the cleaner housing interior for upward flow through the thrust tubes 137 thereby creating a reaction down-force applied to the cleaner. The thrust tubes 137 can be oriented in an upright vertical orientation as shown, or alternately set at a selected and preferably rearwardly tilted angle to produce a combination of down-force and forward-directed reaction force applied to the pool cleaner. Such forces beneficially enhance cleaner traction, and thereby provide improved wall climbing performance.

Figure 24:
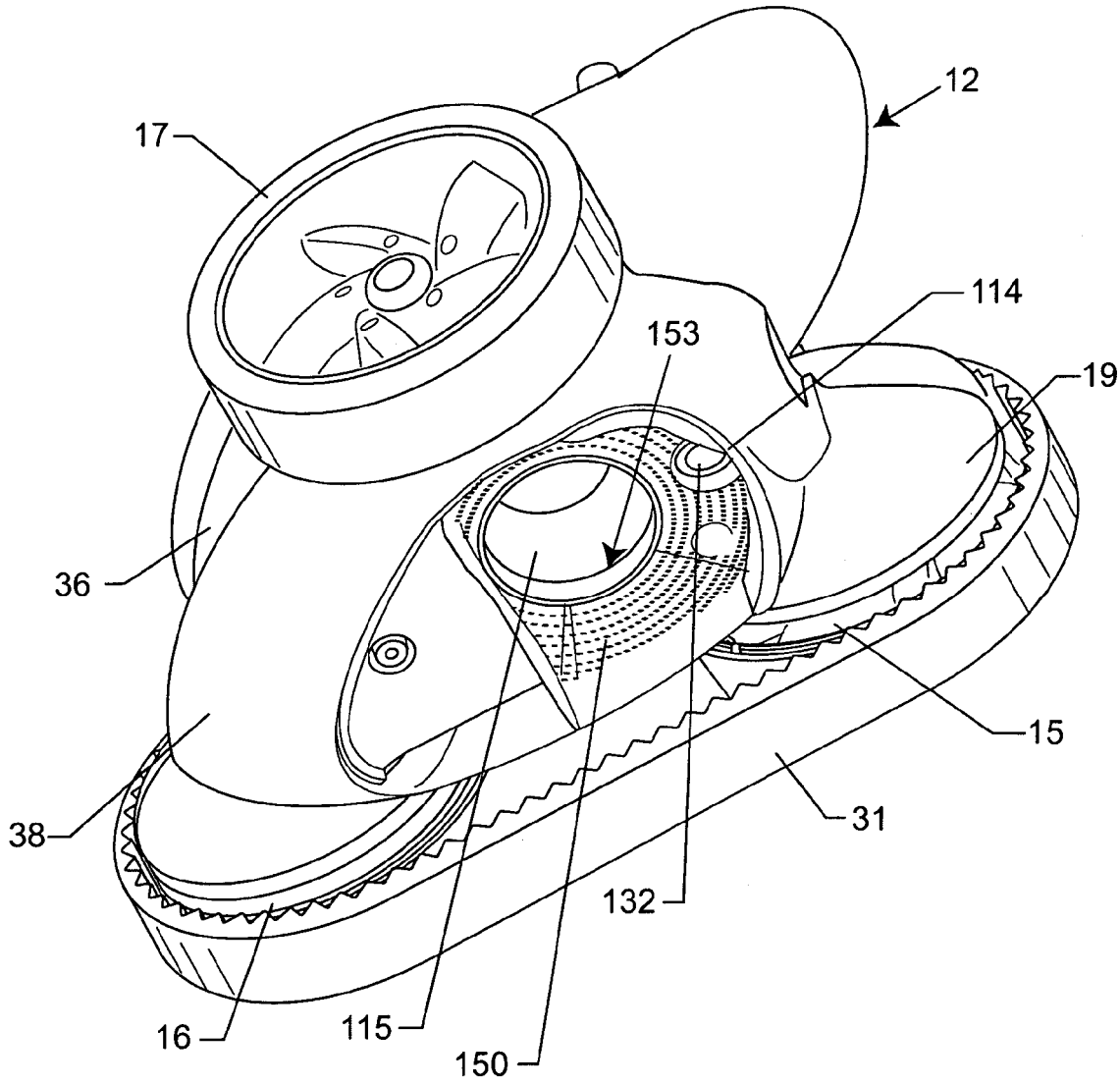
FIG. 24 is a bottom perspective view of the pool cleaner similar to FIG. 3, but with a vacuum plate removed to show an internally mounted filter screen.

FIG. 24 is an underside perspective view of the pool cleaner 10, with the vacuum plate 140 (FIG. 20) removed from the lower housing shell 38 to accommodate quick and easy access to internal components for service and/or repair. In this regard, as viewed in FIG. 3, the vacuum plate 140 comprises an access panel having the generally upwardly extending tapered central transition segment 141 of truncated conical shape, leading upwardly to the underside of the manifold unit 114 and suction mast 22. From a lower margin of this tapered wall segment 141, the vacuum plate 140 extends outwardly generally as a smooth continuation of the lower housing shell 38, and is removably fastened to the internal frame 40 as by screws (not shown). Accordingly, when installed, the vacuum plate 140 effectively comprises a smooth-surfaced continuation of the hydraulic or streamlined profile provided by the lower housing shell 38 of the cleaner housing 12.

The vacuum plate 140 is quickly and easily removable when needed to expose internal cleaner components. FIG. 24 shows a perforated strainer or filter screen 150 installed above the vacuum plate 140, with an outer wall margin 152 extending downwardly therefrom whereby the filter screen 150 cooperates with the vacuum plate 140 (when installed) to define a filtered chamber 153. Importantly, the pump inflow port 132 (FIGS. 18 and 20-21) is in open communication with this filtered chamber 153, whereby water drawn into and pumped by the water supply pump 20 comprises filtered water drawn downwardly within the cleaner housing interior and through the filter screen 150 into said filtered chamber 153. Accordingly, the filter screen 150 prevents large particulate and debris from being drawn into flow paths defined by the manifold unit 114. The vacuum plate 140 is periodically removable to permit access to the filter screen 150 for cleaning, as needed.

For improved and controlled buoyancy within the pool 14, the cleaner 10 may further include one or more buoyant members such as foam floats or the like mounted within the cleaner housing at selected locations. In this regard, FIG. 7 shows a first, relatively large float member 190 mounted within the upper housing shell 36 at a location forward of the suction mast. FIG. 7 also depicts smaller float members 192 and 194 mounted respectively at a mid-height location between the drive motors 18 and the suction mast 22, and also at one or more rearward locations behind the water pump 18. These float members 190, 192 and 194 cooperate with the sealed hollow compass chamber to provided selected buoyancy characteristics for the cleaner 10, such as increased buoyancy with a lowered center of gravity. In addition, these float members assist in off-setting or counterbalancing the mass of the otherwise relatively heavy electric motor components.

Figure 25:
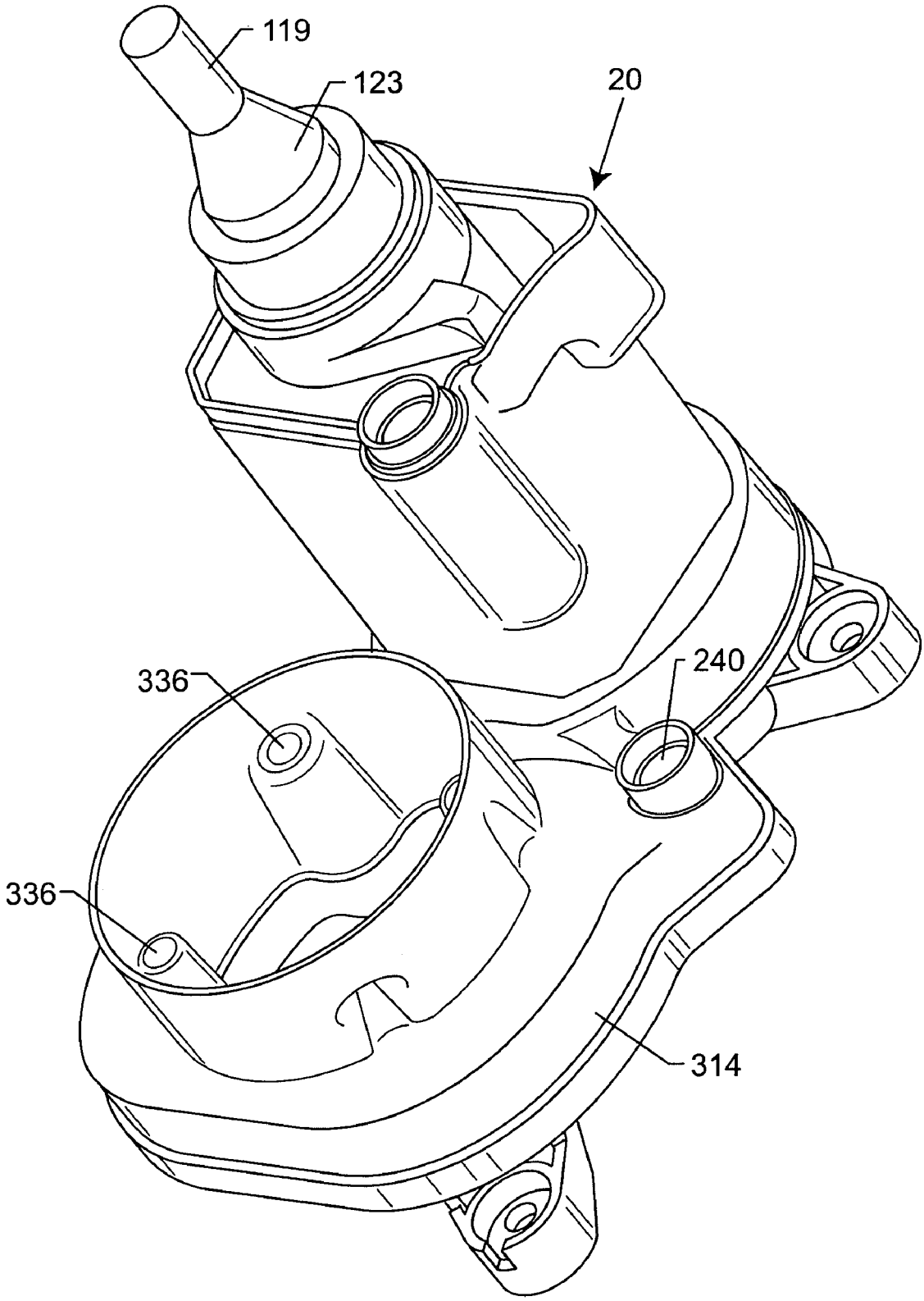
FIG. 25 is an enlarged top perspective view similar to FIG. 17, but depicting a water supply pump and manifold unit constructed in accordance with one alternative preferred form of the invention.

FIG. 25 illustrates one preferred alternative form for the manifold unit, wherein a modified manifold unit 314 includes a plurality of upwardly directed jet nozzles 336 (four of which are shown in the illustrative drawing) for providing a plurality of upwardly directed jet flows into the interior of the suction mast. The modified manifold unit 314 and related water supply pump 20 otherwise conforms in structure and function to that previously shown and described herein.

Figure 26:
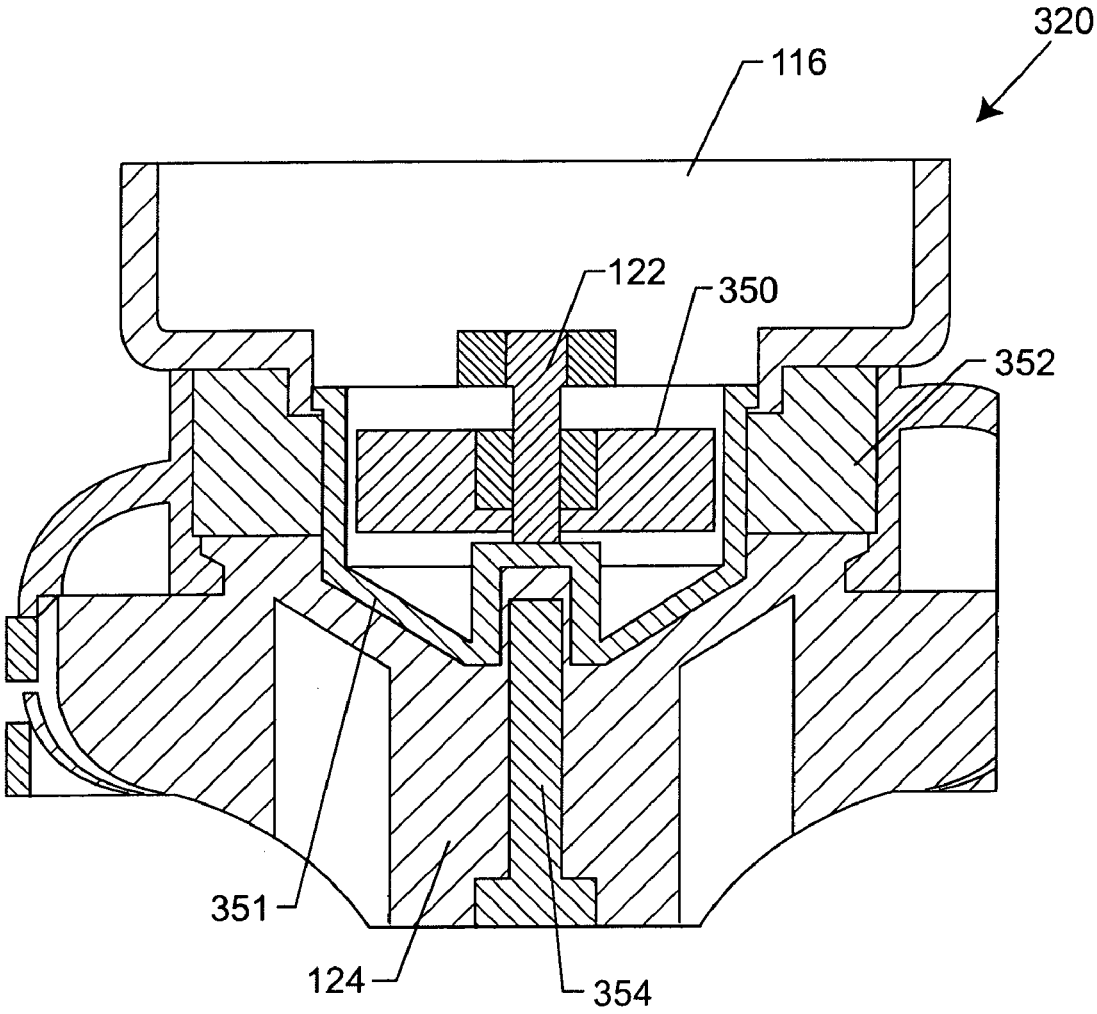
FIG. 26 is an enlarged and fragmented vertical sectional view similar to FIG. 21, but illustrating one alternative preferred form including a modified water supply pump having a magnetic drive coupling.

FIG. 26 shows one preferred alternative form for the water supply pump, wherein a modified water supply pump 320 incorporates a magnetic coupling of pump drive shaft 122 with the driven impeller 124, thereby providing a positive and leak-free hermetically sealed drive connection. As shown, the rotatably driven pump drive shaft 122 carries a rotatably driven inner magnet 350 for rotary drive movement within a nose end 351 of a closed and sealed pump housing. This inner magnet 350 is disposed in magnetic drive-coupled relation, through the nose end 351 of the pump housing, with a cylindrical or outer ring magnet 352 mounted onto the impeller 124. As shown, the impeller 124 is rotatably carried on a stub shaft 354 projecting downwardly from the housing nose end 351. In operation, the pump drive shaft 122 rotatably drives the impeller 124 via the magnetic coupling comprising the inner magnet 350 and the outer ring magnet 352.

Figure 27:
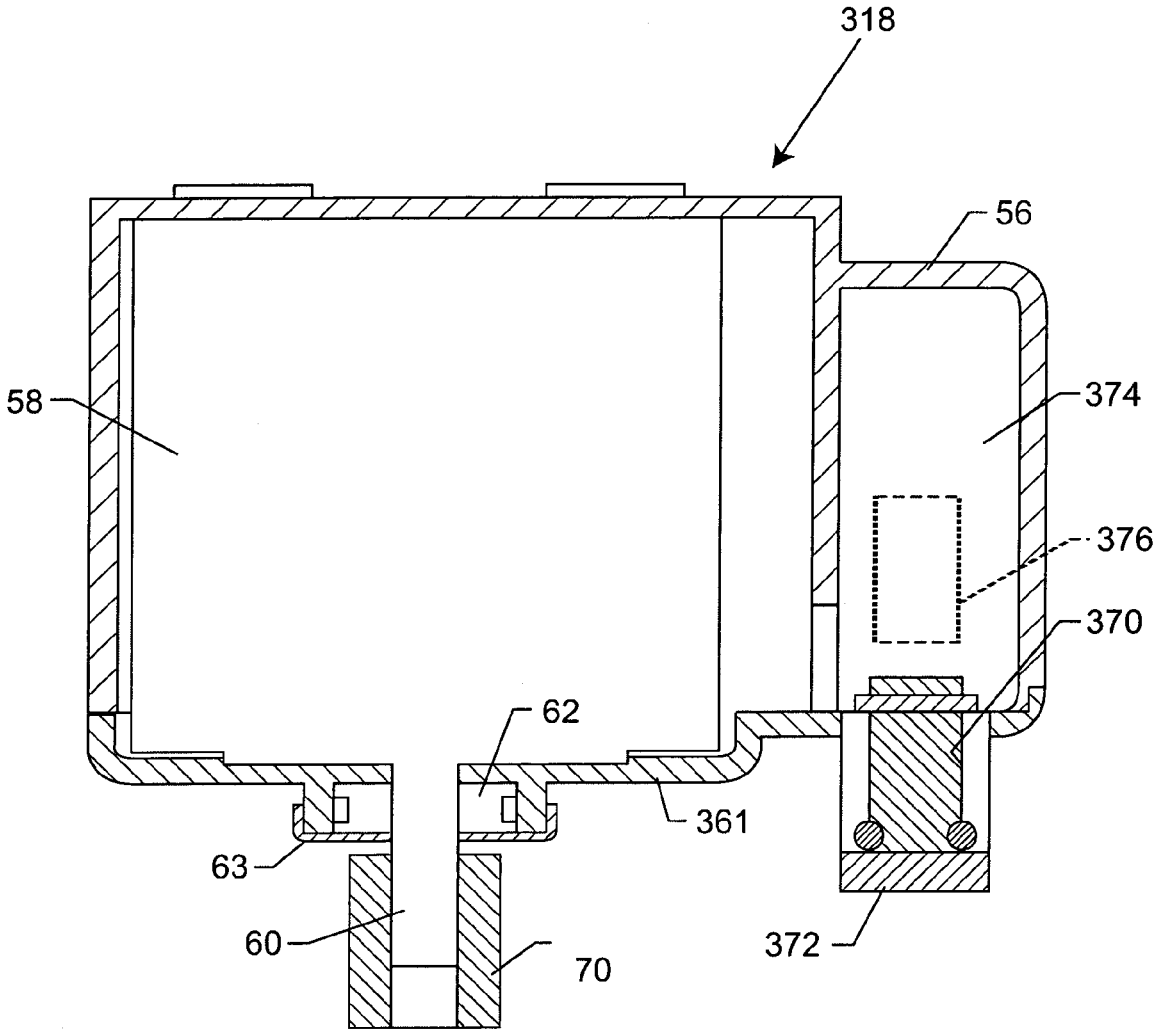
FIG. 27 is an enlarged and somewhat schematic vertical sectional view showing a modified drive motor constructed in accordance with one alternative preferred form of the invention.

A modified preferred form of a drive motor for use in driving the cleaner wheels is shown, somewhat in schematic form, in FIG. 27. As shown, the modified drive motor 318 comprises a drive motor unit 58 of the type previously shown and described herein, wherein a modified housing cap 361 is mounted onto a housing base 56 to encase the drive motor unit 58. The modified housing cap 361 incorporates an inspection port 370 defined by a cylindrical wall and adapted for closure by means of a plug 372. This inspection port 370 permits pre-installation testing and pressurization of the assembled drive motor housing 58, 361 for leaks, as by applying air pressure to the housing interior and then monitoring for leak-indicative pressure drops. In one form, the plug 372 may comprise a Schrader-type valve for facilitated pressurization of the motor housing interior. In another preferred form, the motor housing interior can be filled with a gas such as nitrogen, having larger molecules (in comparison with air) and thus less likely to leak. In a further and/or additional aspect of the invention, the inspection port 370 may be associated with an internal chamber 374 in which a selected desiccant 376 may be installed to collect and retain moisture, thereby keeping the interior atmosphere dry and reducing corrosion of motor components.

While the inspection port 370 and related concepts shown and described with respect to FIG. 27 are directed to the traction drive motors, it will be understood that these features and concepts may alternately or in addition be applied to each of the water supply pump of the pool cleaner.

Figure 19:
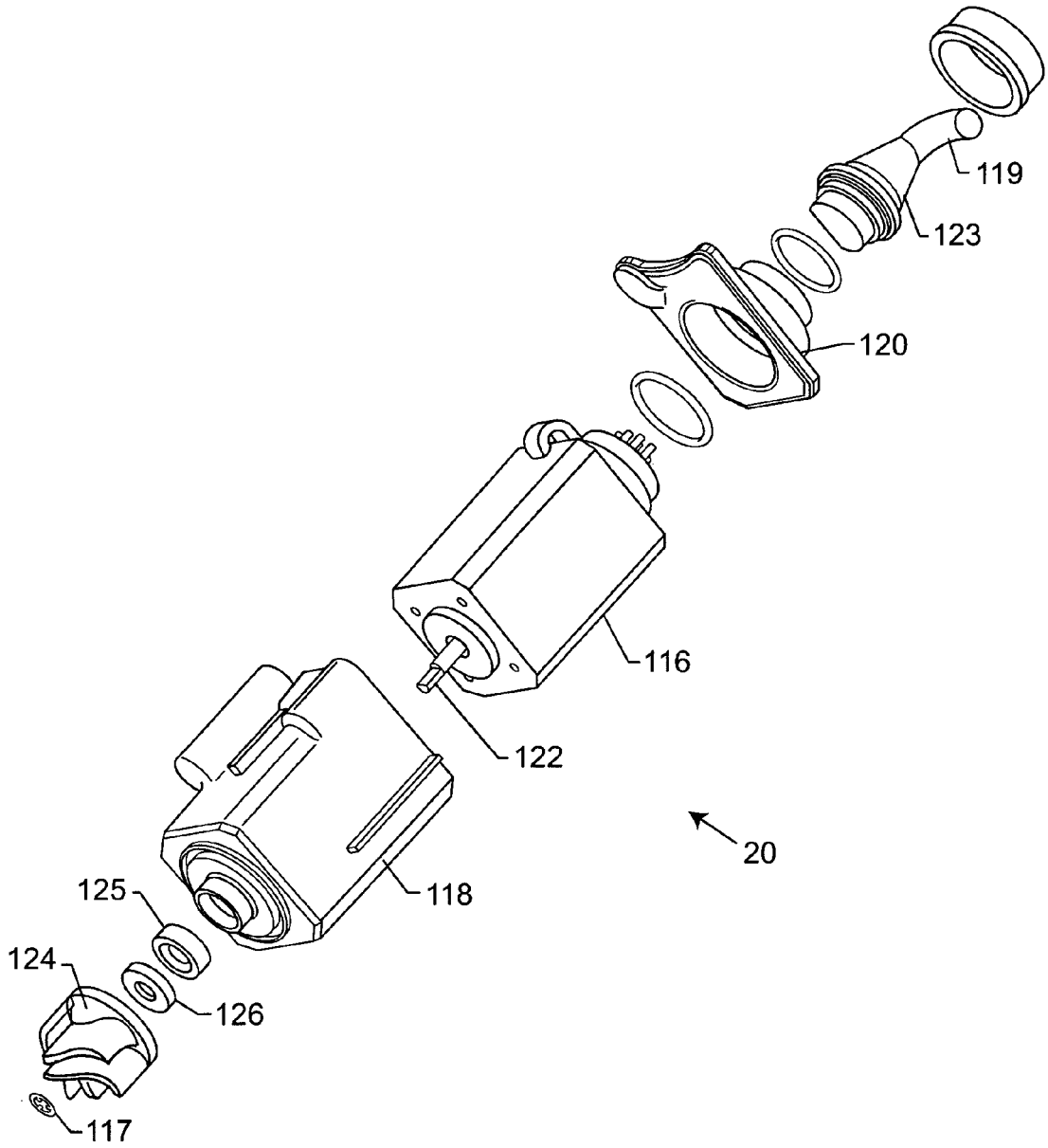
FIG. 19 is an exploded perspective view of the water supply pump of FIGS. 17-18.
Figure 20:
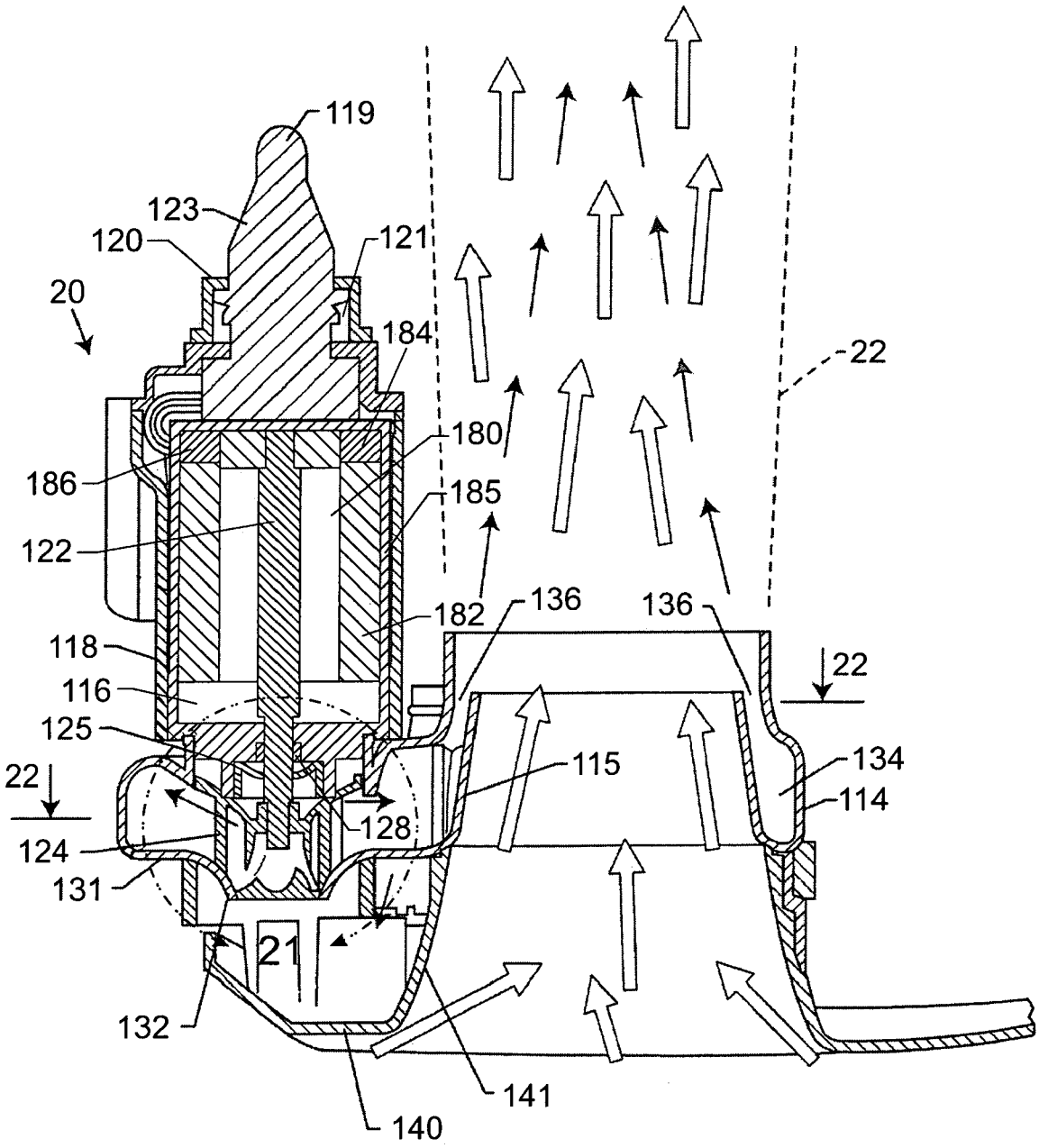
FIG. 20 is an enlarged and fragmented vertical sectional view showing the water supply pump and manifold unit of FIGS. 17-19 in operative association with a pool cleaner suction mast.
Figure 28:
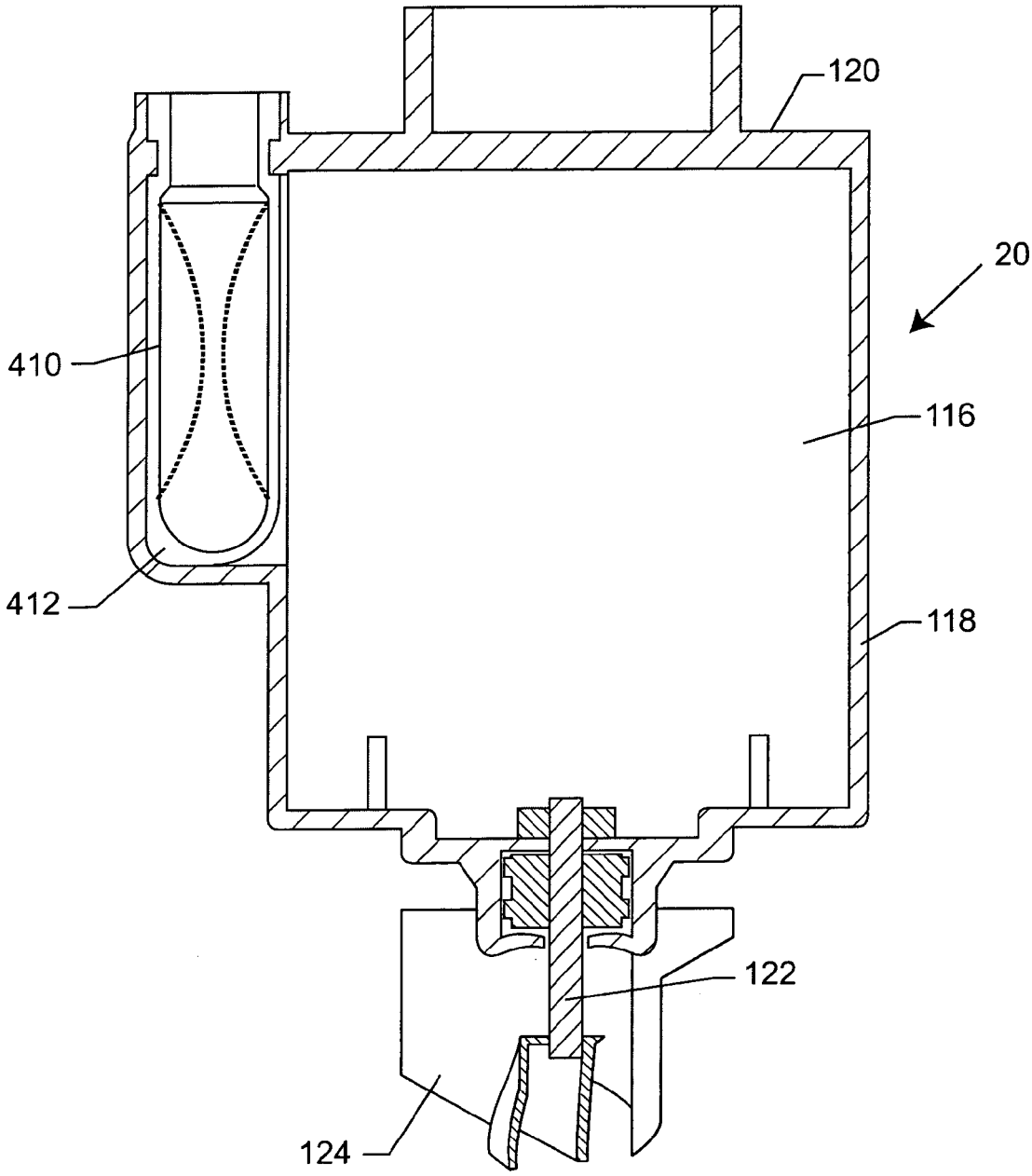
FIG. 28 is an enlarged and somewhat schematic vertical sectional view depicting a modified water supply pump constructed in accordance with a further alternative preferred form of the invention.

FIG. 28 depicts a further modified water supply pump, which may be constructed according to the embodiments shown in FIGS. 19 and 26 hereof, and modified further to incorporate a pressure equalization membrane 410. The pressure equalization membrane 410 comprises a resilient bulb-shaped wall carried within a ported side chamber 412 on the pump housing, with one side of the membrane exposed to water within the pool cleaner 10, and the opposite side exposed to the pump interior. With this construction, as the pump interior temperature increases during drive motor operation for rotatably driving the impeller 124, the membrane 410 flexibly deforms (dotted line position in FIG. 28) to prevent pressure increase within the pump housing interior. Thereafter, as the interior temperature decreases following cessation of pump drive motor operation, the membrane again flexibly deforms to prevent a vacuum (relative to the surrounding pool water) within the pump housing interior. Thus, the deformable membrane 410 effectively maintains the pressure within the pump housing interior substantially equal to the surrounding water pressure, thereby preventing pressure differentials which can contribute to undesired water ingestion into the pump housing interior.

While the pressure equalization membrane 410 is shown and described with respect to the water supply pump, persons skilled in the art will recognize and appreciate that this feature may alternately or in addition be applied to each of the traction drive motors 18 of the pool cleaner.

In accordance with a further aspect of the invention, a sensor 510 (FIG. 4) may be employed in combination with the processor 54 for safeguarding the cleaner components against one or more failure modes. As shown in one preferred form, this sensor 510 may comprise a conductivity sensor unit comprising a pair of conductivity probes 512 and 514 mounted within the cleaner housing at a selected location for normal contact with and/or immersion within pool water, when the pool cleaner is submerged within the pool water for normal operation. The conductivity probes 512, 514 are designed to detect the presence of the water, by means of conductivity of particles within the water, to signal the processor 54 that the cleaner is in the pool. Conversely, the probes 512, 514 will also detect the absence of the water therebetween, and thereupon signal the processor 54 that the cleaner may not be in the water for proper operation. In this latter event, the processor 54 can be programmed to cease cleaner operation unless and until the cleaner is returned to the water. As one alternative, the processor 54 may be programmed for initial corrective action, such as one or more back-up and/or selected turning cycles, before turning the cleaner off if water remains undetected by the probes.

The sensor 510 may take alternative forms, including but not limited to electronic sensor devices for monitoring electronic parameters such a motor or pump current condition, such as a change in current draw reflective of the cleaner being removed from the water, or other changes in current draw reflective of a pump overload condition. Or, if desired, the sensor 510 may comprise a temperature sensor for monitoring motor or pump operating temperature. In either case, the sensor 510 signals the processor 54 in the event of a non-normal detected condition, whereupon the processor 54 may be programmed for turning the cleaner off, or alternately for attempting corrective action before turning the cleaner off (if the corrective action is not successful).

A variety of further modifications and improvements in and to the improved automatic pool cleaner 10 of the present invention will be apparent to those persons skilled in the art. Accordingly, no limitation on the invention is intended by way of the foregoing description and accompanying drawings, except as set forth in the appended claims.

What is claimed is:

1. A pool cleaner for travel along submerged surfaces of a swimming pool to collect and dislodge debris, comprising:

a cleaner housing;

an electric powered traction drive system for effecting movement of the cleaner housing;

a processor for controllably coupling electric power to said traction drive system for controlling the direction of cleaner travel;

a power inlet;

a power cable releasibly coupled to said power inlet for connecting said processor to a power source disposed outside the swimming pool, said processor effecting operation of said traction drive system in a manner preventing excess twisting of said power cable; and a quick connect, quick-disconnect disconnect hermetically sealed coupling assembly for releasibly coupling said power cable to said power inlet, the coupling assembly comprising a releasible coupling, at least one of the power inlet or the releasible coupling comprising depressible means for releasing the releasible coupling from the power inlet.

2. The pool cleaner of claim 1 further including a suction mast having an open lower end exposed through said housing to an underside of said housing, and an upper end positioned for removable mounting of a debris collection bag; and a water management system including an electric powered water supply pump for producing a discharge flow of water under pressure, and a manifold unit including at least one upwardly directed jet nozzle for inducing an upward hydraulic vacuum flow through said suction mast for drawing water and entrained debris upwardly through said suction mast.

3. The pool cleaner of claim 1 in which the power inlet includes a cable fitting to which the power cable is releasibly coupled.

4. The pool cleaner of claim 1 in which the cleaner housing is rotatably supported by a plurality of wheels including at least one right-side wheel and at least one left-side wheel at opposite sides of said housing.

5. The pool cleaner of claim 4 in which the traction drive system rotatably drives at least one of the plurality of wheels.

6. The pool cleaner of claim 1 in which the traction drive system comprises at least one stepper motor.

7. The pool cleaner of claim 1 further comprising an on-board compass to which the processor is responsive.

8. The pool cleaner of claim 1 further comprising at least one status-indicating signal light.

9. The pool cleaner of claim 8 in which the processor controls activation of the signal light.

10. The pool cleaner of claim 1 further comprising a sensor including a pair of spaced-apart probes for detecting a characteristic of water between said probes.

11. The pool cleaner of claim 1 in which the releasible coupling comprises the depressible means and a spring.

12. The pool cleaner of claim 11 in which the depressible means comprises a lock key configured for depression against the spring.

13. The pool cleaner of claim 12 in which the lock key is slidable.

14. The pool cleaner of claim 13 in which the fitting comprises a lock groove configured for engagement by the lock key.

15. The pool cleaner of claim 14 in which the power inlet includes a fitting further comprising a fitting collar and a first seal ring carried about the fitting collar.

16. The pool cleaner according to claim 15 further comprising a second seal ring carried about the fitting collar.

17. A pool cleaner for travel along submerged surfaces of a swimming pool to collect and dislodge debris, comprising:

a cleaner housing;

an electric powered traction drive system for effecting movement of the cleaner housing;

a processor for controllably coupling electric power to said traction drive system for controlling the direction of cleaner travel;

a power inlet;

a power cable releasibly coupled to said power inlet for connecting said processor to a power source disposed outside the swimming pool, said processor effecting operation of said traction drive system in a manner preventing excess twisting of said power cable;

a quick connect, quick-disconnect disconnect hermetically sealed coupling assembly for releasibly coupling said power cable to said power inlet; and a sensor including a pair of spaced-apart probes for detecting a characteristic of water between said probes.

* * * * *